US010943519B2

(12) United States Patent
Chuang

(10) Patent No.: US 10,943,519 B2
(45) Date of Patent: Mar. 9, 2021

(54) IMAGE PROCESSING METHOD FOR VERTICAL SUB-PIXEL RENDERING AND DISPLAY DEVICE USING THE SAME

(71) Applicant: HIMAX TECHNOLOGIES LIMITED, Tainan (TW)

(72) Inventor: Chi-Feng Chuang, Tainan (TW)

(73) Assignee: HIMAX TECHNOLOGIES LIMITED, Tainan (TW)

( * ) Notice: Subject to any disclaimer, the term of this patent is extended or adjusted under 35 U.S.C. 154(b) by 31 days.

(21) Appl. No.: 16/286,553

(22) Filed: Feb. 26, 2019

(65) Prior Publication Data

US 2020/0273392 A1 Aug. 27, 2020

(51) Int. Cl.
*G09G 3/20* (2006.01)

(52) U.S. Cl.
CPC ..... *G09G 3/2003* (2013.01); *G09G 3/2074* (2013.01); *G09G 2300/0452* (2013.01)

(58) Field of Classification Search
CPC ..... G09G 3/2003; G09G 3/2074; G09G 2300/0452; G09G 2340/0457
See application file for complete search history.

(56) References Cited

U.S. PATENT DOCUMENTS

2011/0141131 A1 6/2011 Brown et al.
2016/0148579 A1* 5/2016 Kimura ..... G09G 3/3607 345/694

FOREIGN PATENT DOCUMENTS

| | | | |
|---|---|---|---|
| CN | 104821147 | A | 8/2015 |
| CN | 106469533 | A | 3/2017 |
| CN | 106530994 | A | 3/2017 |
| TW | 201614625 | A | 4/2016 |
| TW | 201818384 | A | 5/2018 |

* cited by examiner

*Primary Examiner* — Yaron Cohen
(74) *Attorney, Agent, or Firm* — CKC & Partners Co., LLC

(57) ABSTRACT

An image processing method and a display device are provided. The display device includes a computation circuit and a display panel. In the image processing method, at first, an original image including a straight line pattern and upper pixels is provided. The straight line pattern includes lower pixels opposite to the upper pixels. The display panel includes first lower sub-pixel structures corresponding to the first lower pixels and first upper sub-pixel structures corresponding to the first upper pixels. Thereafter, vertical sub-pixel rendering methods are performed on pixel luminances of the first lower pixels and the upper first upper pixels to obtain rendering sub-pixel luminances of the first lower pixels and the upper first upper pixels. Then, the first lower sub-pixel structures and the first upper sub-pixel structures are driven according to the rendering sub-pixel luminances.

16 Claims, 16 Drawing Sheets

IMAGE PROCESSING METHOD FOR VERTICAL SUB-PIXEL RENDERING AND DISPLAY DEVICE USING THE SAME

BACKGROUND

Field of Invention

The present invention relates to an image processing method and a display device using the image processing method. More particularly, the present disclosure relates to an image processing method for vertical sub-pixel rendering and a display device using the image processing method.

Description of Related Art

In a conventional display panel, multiple sub-pixel structures are arranged as a matrix, and each sub-pixel structure renders one of red, green, and blue colors, and three sub-pixel structures of red, green, and blue constitute a pixel. However, in some panels, one pixel only includes two sub-pixel structures. For example, one pixel may only include one red sub-pixel structure and one green sub-pixel structure, and another pixel may only include one green sub-pixel structure and one blue sub-pixel structure. To correctly render a digital image in this kind of panels, a sub-pixel rendering algorithm is required.

SUMMARY

Embodiments of the present invention provide an image processing method. The image processing method includes: providing an original image, in which the original image includes a straight line pattern and first upper pixels located adjoining an upper side of the straight line pattern, wherein the straight line pattern includes first pixels, second pixels and third pixels, and the first pixels are first lower pixels located at a lower side of the straight line pattern; providing a display panel configured to display the original image, in which the display panel includes first sub-pixel structures corresponding to the first lower pixels and the first upper pixels, second sub-pixel structures corresponding to the second pixels and third sub-pixel structures corresponding to the third pixels, and the first sub-pixel structures includes first lower sub-pixel structures corresponding to the first lower pixels and first upper sub-pixel structures corresponding to the first upper pixels; obtaining first pixel luminances of the first lower pixels and second pixel luminances of the first upper pixels in accordance with the original image, wherein the first pixels correspond to a predetermined rendering color; performing a first vertical sub-pixel rendering method on the first pixel luminances according to a first color ratio to obtain first rendering sub-pixel luminances; performing a second vertical sub-pixel rendering method on the second pixel luminances according to a second color ratio to obtain second rendering sub-pixel luminances; transforming the first rendering sub-pixel luminances into first rendering grey levels, and transforming the second rendering sub-pixel luminances into second rendering grey levels; driving the first lower sub-pixel structures according to the first rendering grey levels; and driving the first upper sub-pixel structures according to the second rendering grey level.

In some embodiments, the first vertical sub-pixel rendering method is performed according to a following equation:

$$fL_{fp}'=f\beta\times fL_{fp}$$

wherein fβ is the first color ratio, fp is a position of the lower sub-pixel structure, $fL_{fp}$ is the pixel luminance of the lower pixel corresponding to the position lp, and $fL_{fp}'$ is the first rendering sub-pixel luminance.

In some embodiments, fβ is 0.25.

In some embodiments, the second vertical sub-pixel rendering method is performed according to a following equation:

$$sL_{sp}'=(1-s\beta)\times sL_{l(sp)}$$

wherein sβ is the second color ratio, sp is a position of the upper sub-pixel structure, l(sp) is a position of an adjacent sub-pixel structure closest to and under the upper sub-pixel structure at the position sp, and the adjacent sub-pixel structure has a color the same as the upper sub-pixel structure at the position sp, and $sL_{sp}'$ is the second rendering sub-pixel luminance.

In some embodiments, sβ is 0.25.

In some embodiments, the first sub-pixel structures correspond to green, the second sub-pixel structures correspond to red, and the third sub-pixel structures correspond to blue.

In some embodiments, the original image further includes a lower boundary line pattern and second upper pixels located adjoining an upper side of the lower boundary line pattern, the lower boundary line pattern includes fourth pixels, fifth pixels and sixth pixels, and the fourth pixels are second lower pixels located at a lower side of the lower boundary line pattern. The display panel further includes fourth sub-pixel structures corresponding to the second lower pixels and the second upper pixels, fifth sub-pixel structures corresponding to the fifth pixels and sixth sub-pixel structures corresponding to the sixth pixels, and the fourth sub-pixel structures includes second lower sub-pixel structures corresponding to the second lower pixels and second upper sub-pixel structures corresponding to the second upper pixels.

In some embodiments, the image processing method further includes obtaining third pixel luminances of the second lower pixels and fourth pixel luminances of the second upper pixels in accordance with the original image, wherein the fourth pixels correspond to the predetermined rendering color; performing a third vertical sub-pixel rendering method on the third pixel luminances according to a third color ratio to obtain third rendering sub-pixel luminances; performing a fourth vertical sub-pixel rendering method on the third pixel luminances according to a fourth color ratio to obtain fourth rendering sub-pixel luminances; transforming the third rendering sub-pixel luminances into third rendering grey levels, and transforming the fourth rendering sub-pixel luminances into fourth rendering grey levels; driving the second lower sub-pixel structures according to the third rendering grey levels; driving the second upper sub-pixel structures according to the fourth rendering grey level.

In some embodiments, the third vertical sub-pixel rendering method is performed according to a following equation:

$$tL_{tp}'=t\beta\times tL_{tp}$$

Wherein tβ is the third color ratio, $tL_{tp}$ is the third pixel luminance corresponding to the second lower pixel at the position tp, and $tL_{tp}'$ is the third rendering sub-pixel luminance corresponding to the position tp.

In some embodiments, tβ is 0.25.

In some embodiments, the fourth sub-pixel structures correspond to green, the fifth sub-pixel structures correspond to red, and the sixth sub-pixel structures correspond to blue.

In some embodiments, the original image further includes an upper boundary line pattern, the upper boundary line pattern includes seventh pixels, eighth pixels and ninth pixels, and the seventh pixels are located at a lower side of the upper boundary line pattern. The display panel further includes seventh sub-pixel structures corresponding to the seventh pixels, eighth sub-pixel structures corresponding to the eighth pixels, ninth sub-pixel structures corresponding to the ninth pixels, tenth sub-pixel structures adjacent to the seventh sub-pixel structures, eleventh sub-pixel structures adjacent to the eighth sub-pixel structure, twelfth sub-pixel structures adjacent to the ninth pixels sub-pixel structure. The tenth sub-pixel structures and the seventh sub-pixel structures correspond to the same color, the eleventh sub-pixel structures and the eight sub-pixel structures correspond to the same color, and the twelfth sub-pixel structures and the ninth sub-pixel structures correspond to the same color.

In some embodiments, the image processing method further includes obtaining fifth pixel luminances of the seventh pixels in accordance with the original image, wherein the seventh pixels correspond to the predetermined rendering color; performing a fifth vertical sub-pixel rendering method on the fifth pixel luminances according to a fifth color ratio to obtain fifth rendering sub-pixel luminances; performing a sixth vertical sub-pixel rendering method on a sixth pixel luminance according to a sixth color ratio to obtain sixth rendering sub-pixel luminances, wherein the sixth pixel luminance is a predetermined value; transforming the fifth rendering sub-pixel luminances into fifth rendering grey levels, and transforming the sixth rendering sub-pixel luminances into sixth rendering grey levels; driving the seventh sub-pixel structures according to the sixth rendering grey levels; and driving the tenth sub-pixel structures according to the fifth rendering grey levels.

In some embodiments, the seventh sub-pixel structures correspond to green, the eighth sub-pixel structures correspond to red, and the ninth sub-pixel structures correspond to blue.

From another aspect, embodiments of the invention provide a display device including a display panel and a computation circuit. The computation circuit is configured to receive an original image, wherein the original image includes a straight line pattern and first upper pixels located adjoining an upper side of the straight line pattern, wherein the straight line pattern includes first pixels, second pixels and third pixels, and the first pixels are first lower pixels located at a lower side of the straight line pattern. The display panel is configured to display the original image, wherein the display panel includes first sub-pixel structures corresponding to the lower pixels and the first upper pixels, second sub-pixel structures corresponding to the second pixels and third sub-pixel structures corresponding to the third pixels, and the first sub-pixel structures includes first lower sub-pixel structures corresponding to the first lower pixels and first upper sub-pixel structures corresponding to the first upper pixels. The computation circuit is further configured to: obtain each of grey levels of the first lower pixels and the first upper pixels to obtain first pixel luminances of the first lower pixels and second pixel luminances of the first upper pixels, wherein the first pixels correspond to a predetermined rendering color; perform a first vertical sub-pixel rendering method on the first pixel luminances according to a first color ratio to obtain first rendering sub-pixel luminances; perform a second vertical sub-pixel rendering method on the second pixel luminances according to a second color ratio to obtain second rendering sub-pixel luminances; transform the first rendering sub-pixel luminances into first rendering grey levels, and transforming the second rendering sub-pixel luminances into second rendering grey levels; drive the first lower sub-pixel structures according to the first rendering grey levels; and drive the first upper sub-pixel structures according to the second rendering grey level.

In some embodiments, the first vertical sub-pixel rendering method is performed according to a following equation:

$$fL_{fp}'=f\beta\times fL_{fp}$$

wherein fβ is the first color ratio, fp is a position of the lower sub-pixel structure, $fL_{fp}$ is the pixel luminance of the lower pixel corresponding to the position lp, and $fL_{fp}'$ is the first rendering sub-pixel luminance.

In some embodiments, fβ is 0.25.

In some embodiments, the second vertical sub-pixel rendering method is performed according to a following equation:

$$sL_{sp}'=(1-s\beta)\times sL_{l(sp)}$$

wherein sβ is the second color ratio, sp is a position of the upper sub-pixel structure, l(sp) is a position of an adjacent sub-pixel structure closest to and under the upper sub-pixel structure at the position sp, and the adjacent sub-pixel structure has a color the same as the upper sub-pixel structure at the position sp, and $sL_{sp}'$ is the second rendering sub-pixel luminance.

In some embodiments, sβ is 0.25.

In some embodiments, the first sub-pixel structures correspond to green, the second sub-pixel structures correspond to red, and the third sub-pixel structures correspond to blue.

BRIEF DESCRIPTION OF THE DRAWINGS

The invention can be more fully understood by reading the following detailed description of the embodiment, with reference made to the accompanying drawings as follows.

DETAILED DESCRIPTION

Specific embodiments of the present invention are further described in detail below with reference to the accompanying drawings, however, the embodiments described are not intended to limit the present invention and it is not intended for the description of operation to limit the order of implementation. Moreover, any device with equivalent functions that is produced from a structure formed by a recombination of elements shall fall within the scope of the present invention. Additionally, the drawings are only illustrative and are not drawn to actual size.

The using of "first", "second", "third", etc. in the specification should be understood for identifying units or data described by the same terminology, but are not referred to particular order or sequence.

Figure 1:
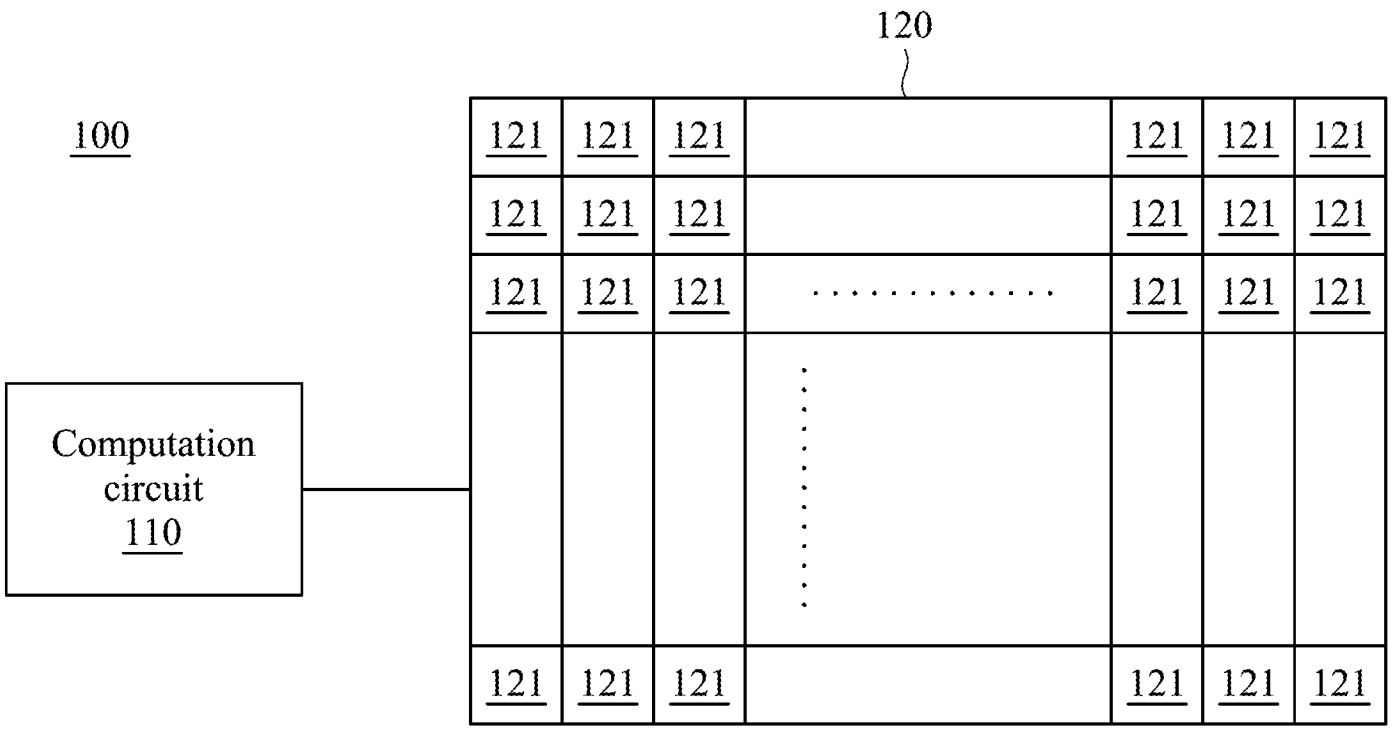
FIG. 1 is a schematic diagram illustrating a display device in accordance with embodiments of the present invention.

Referring to FIG. 1, FIG. 1 is a schematic diagram illustrating a display device in accordance with embodiments of the present invention. Referring to FIG. 1, a display device 100 includes a computation circuit 110 and a display panel 120. The computation circuit 110 receives an input image and generates grey levels for the display panel 120. The computation circuit 110 may be a timing controller, an image processor, an application-specific integrated circuit, or any suitable circuit disposed in the display device 100. The display panel 120 includes multiple sub-pixel structures 121. The display panel 120 may be a liquid crystal display panel or an organic light emitting display panel, but embodiments of the present invention are not limited thereto.

The input image received by the computation circuit 110 includes multiple pixels. Each of the pixels includes multiple grey levels, and each of the grey levels corresponds to one of colors which may include red, green, and blue. Each sub-pixel structure 121 also corresponds to one of the colors. In particular, different from a conventional display device in which one pixel corresponds to three sub-pixel structures, one pixel corresponds to two or less sub-pixel structures in this embodiment. For example, if the input image has M rows and N columns where M and N are positive integers, then there are M×N×3 sub-pixel structures in the conventional display panel, but there are M×N×2 sub-pixel structures in this embodiment.

Figure 2:
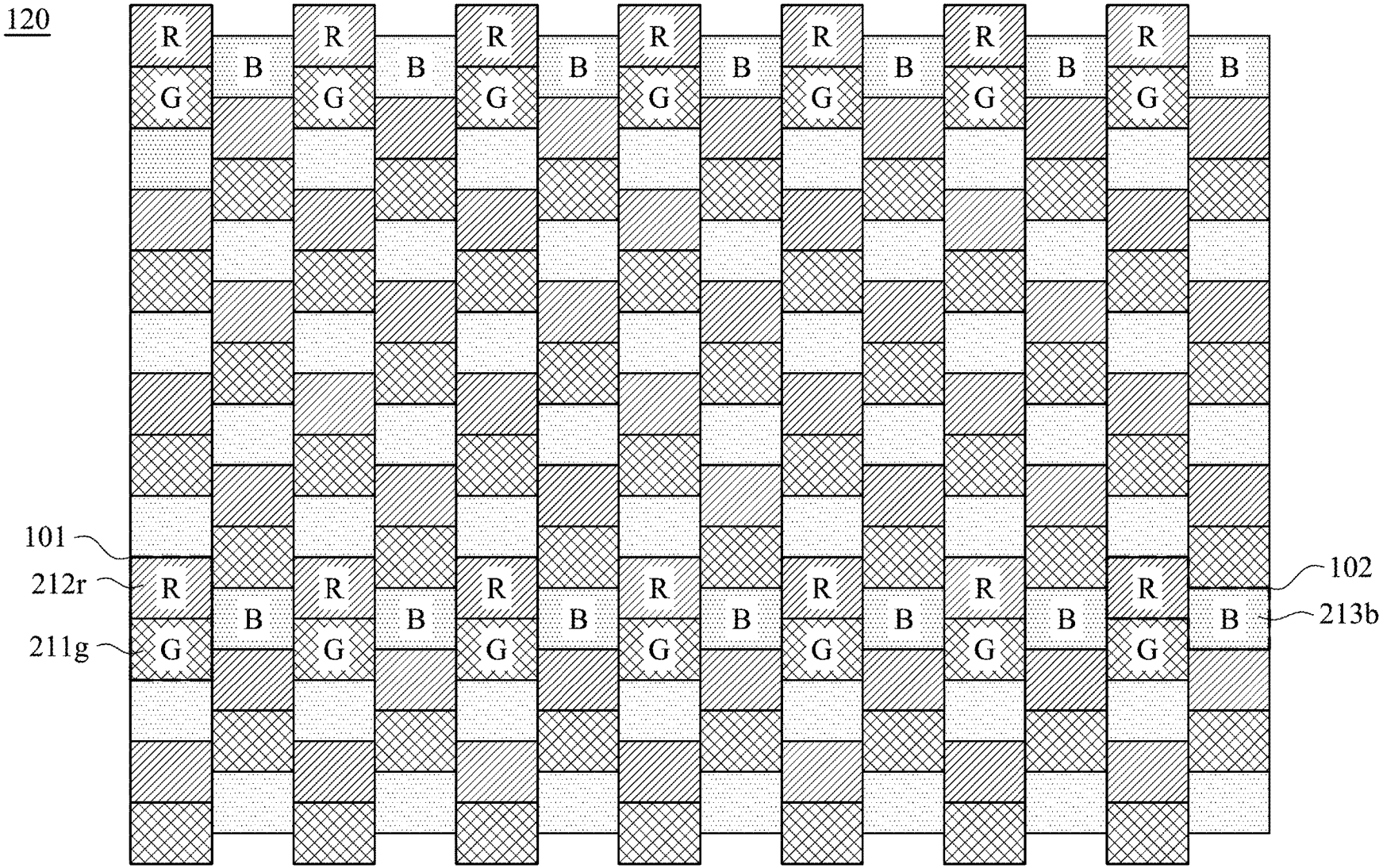
FIG. 2 is a schematic diagram illustrating colors of the sub-pixel structures in the display panel in accordance with embodiments of the present invention.

Referring to FIG. 2, FIG. 2 is a schematic diagram illustrating colors of the sub-pixel structures in the display panel 120 in accordance with embodiments of the present invention. In some embodiments, the sub-pixel structures includes green sub-pixel structures, red sub-pixel structures and blue sub-pixel structures, in which R, G, and B represent red, green, and blue respectively. For example, green sub-pixel structures 211*g* is configured to show green color G, red sub-pixel structures 212*r* is configured to show red color R, and blue sub-pixel structures 213*b* is configured to show blue color B. Two sub-pixel structures surrounded by dash lines correspond to one pixel structure. In some embodiments, a pixel structure 101 including one sub-pixel structure 211*g* and one sub-pixel structure 212*r* correspond to one pixel of the input image. In some embodiments, a pixel structure 102 including one blue sub-pixel structure 213*b* and one red sub-pixel structure 212*r* correspond to one pixel of the input image. It is noted that FIG. 2 illustrates an exemplary arrangement of the sub-pixel structures of the display panel 120. In some embodiments, the display panel 120 may include more sub-pixel structures or less sub-pixel structures.

Figure 3A:
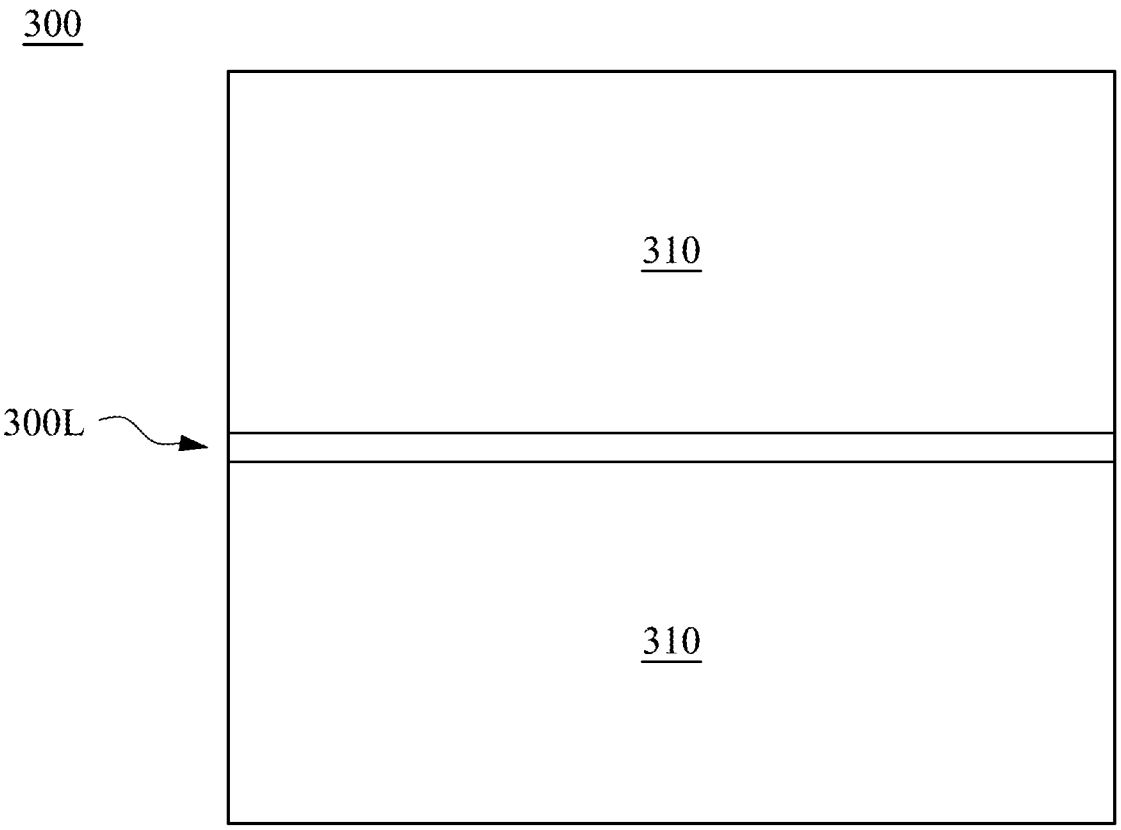
FIG. 3A is a schematic diagram illustrating an input image in accordance with embodiments of the present invention.
Figure 3B:
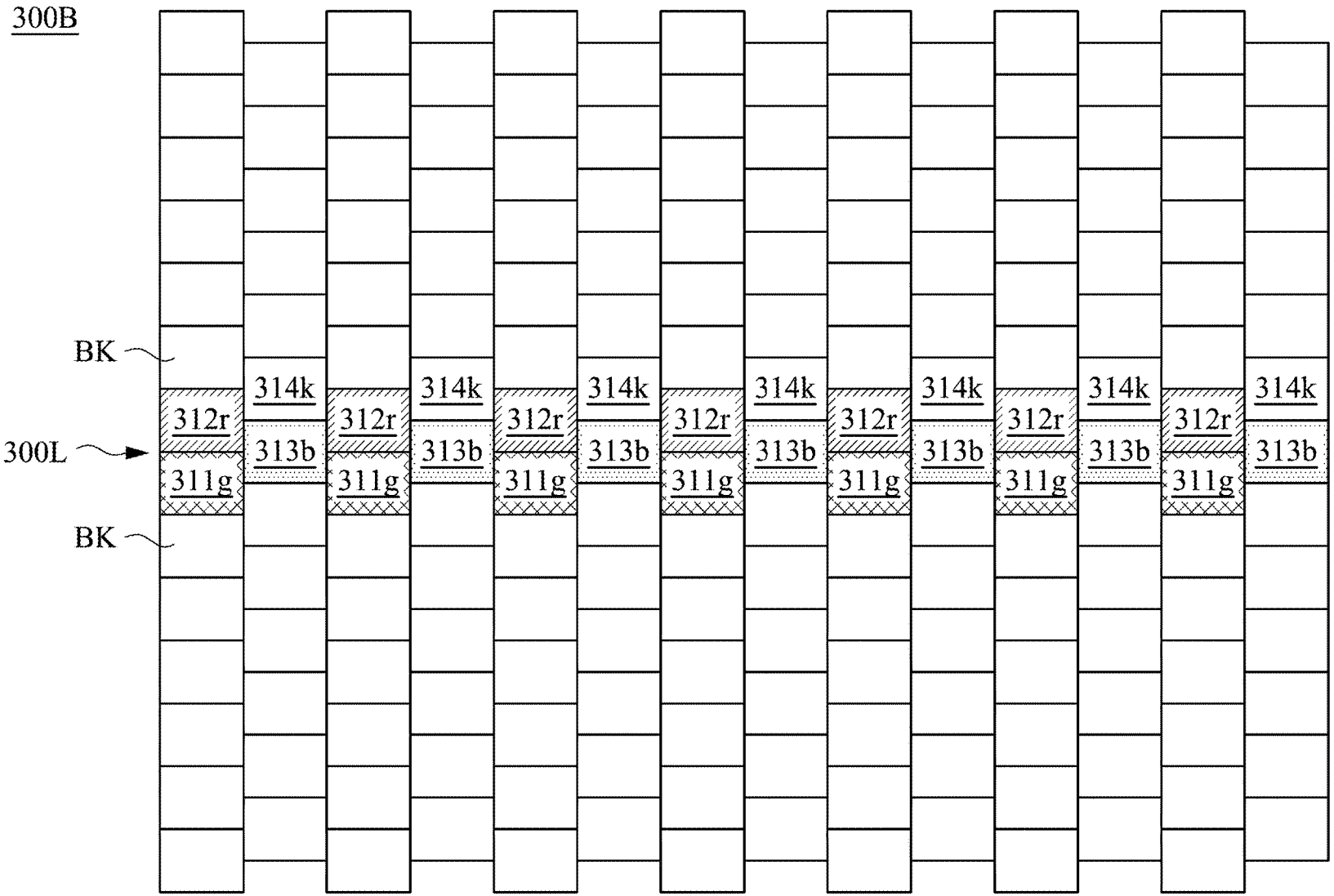
FIG. 3B is a schematic diagram illustrating pixels of an original image corresponding to the sub-pixel structures of the display panel.

Referring to FIG. 3A and FIG. 3B, FIG. 3A is a schematic diagram illustrating an input image 300 in accordance with embodiments of the present invention, and FIG. 3B is a schematic diagram illustrating pixels of an original image 300B corresponding to the sub-pixel structures of the display panel 120. As shown in FIG. 3A, the input image 300 includes a straight line pattern 300L and regions 310 adjoining the straight line pattern 300L. In some embodiments, the straight line pattern 300L is a white line, and the regions 310 adjoining the top and bottom of the straight line pattern 300L are dark. To display the input image 300 through the display panel 120, the computation circuit 110 coverts the input image 300 into an original image 300B as shown in FIG. 3B, in which the original image 300B includes pixels corresponding to the sub-pixel structures of the display panel 120 in a one-to-one manner.

As shown in FIG. 3B, the original image 300 includes pixels 311*g*, pixels 312*r* and pixels 313*b* forming the straight line pattern 300L and black pixels BK forming the dark regions 310. The black pixels BK include black pixels 314*k* located on the straight line pattern 300L and located between the pixels 312*r* and the pixels 313*b*. In some embodiments, the pixels 311*g* are green, the pixels 312*r* are red, and the pixels 313*b* are blue.

Figure 4:
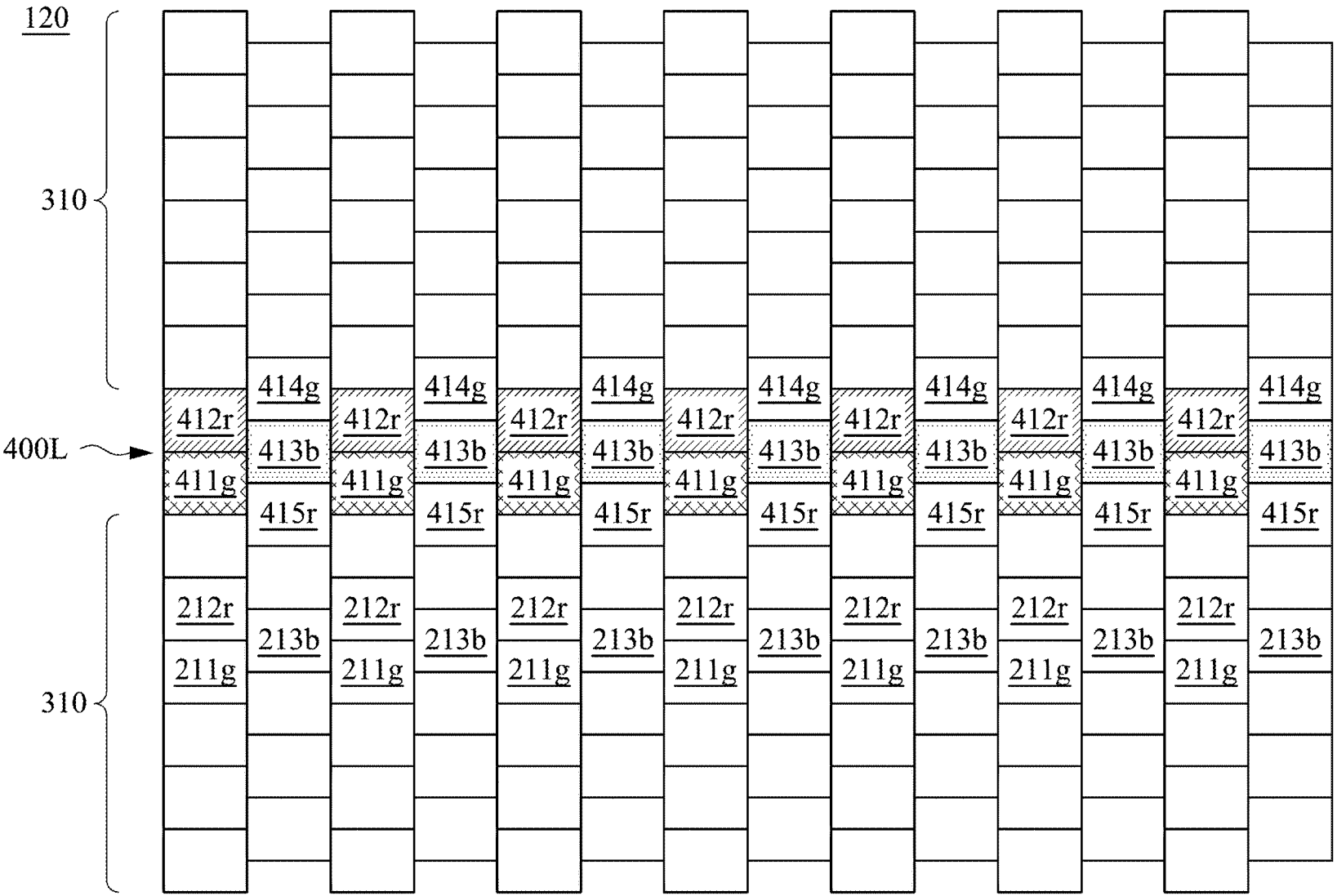
FIG. 4 is a schematic diagram illustrating pixel structures of the display panel showing the original image.

Referring to FIG. 4, when the original image 300B is displayed on the display panel 120, a sub-pixel structure line 400L including sub-pixel structures 411*g*, sub-pixel structures 412*r* and sub-pixel structures 412*b* is driven to show the straight line pattern 300L. In some embodiments, the sub-pixel structures 411*g* are driven to show green color (for example the pixels 311*g*), the sub-pixel structures 412*r* are driven to show red color (for example the pixels 312*r*) and the sub-pixel structures 413*b* are craven to show blue color (for example the pixels 313*b*), thereby enabling the display panel 120 to show the white line pattern 300L. Further, other sub-pixel structures, for example the green sub-pixel structures 211*g*, the red sub-pixel structures 212*r*, the blue sub-pixel structures 213*b*, green sub-pixel structures 414*g* and red sub-pixel structures 415*r* show black color, thereby enabling the display panel 120 to show the dark regions 310. It is noted that the green sub-pixel structures 414*g* show the black pixels 314*k*.

However, a situation of color bleeding may occur on the top side of the sub-pixel structure line 400L and occur under the bottom side of the sub-pixel structure line 400L. For example, the pixels adjacent to the top side of the sub-pixel structure line 400L may look like reddish color. For another example, the pixels adjacent to the bottom side of the sub-pixel structure line 400L may look like greenish color. To reduce the color bleeding, the computation circuit 110 performs vertical sub-pixel rendering on the original image 300B to obtain a sub-pixel rendering image including plural rendering sub-pixel luminances corresponding to the sub-pixel structures of the display panel 120, and drive the display panel 120 by using the rendering sub-pixel luminances.

Figure 5:
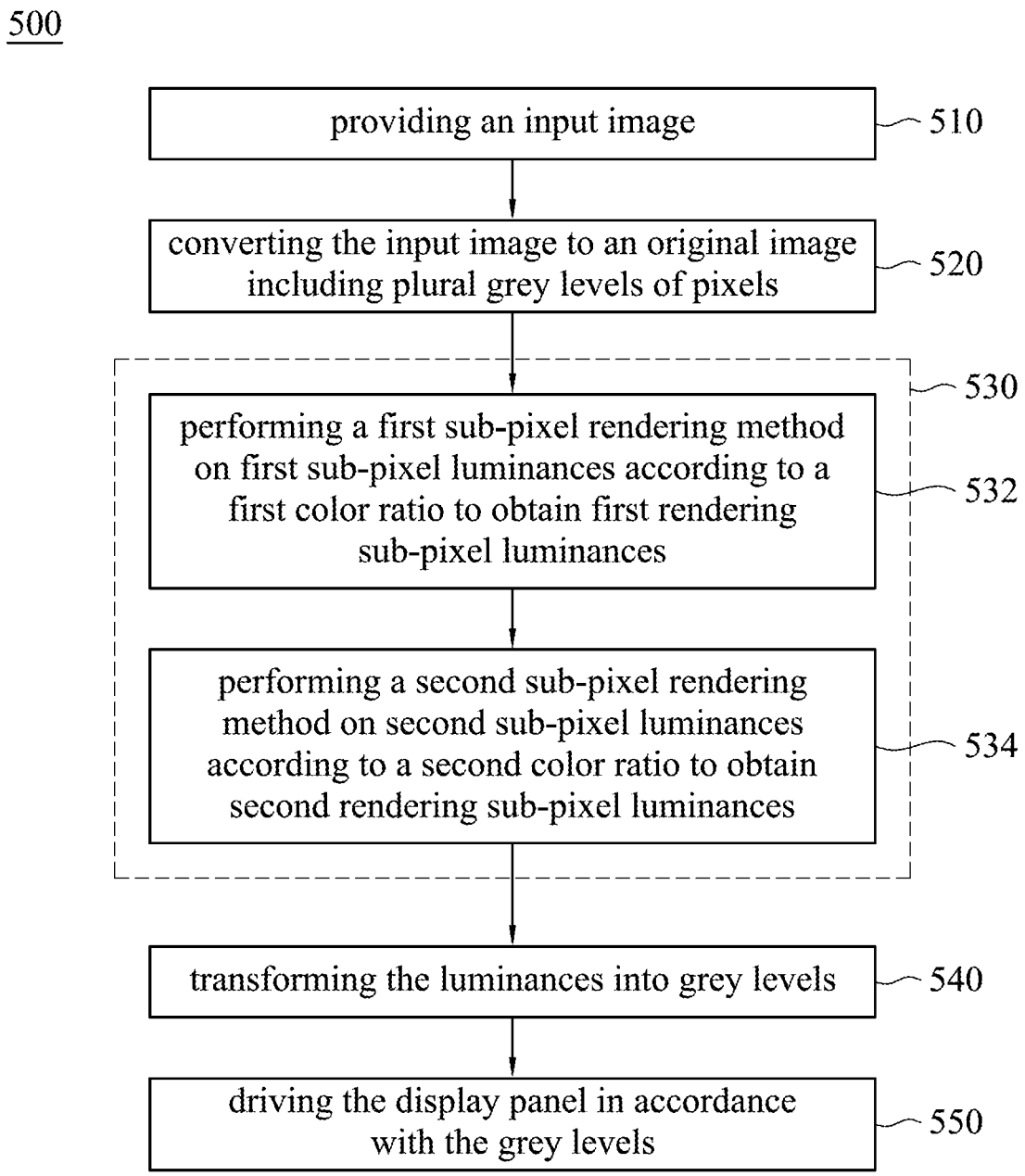
FIG. 5 is a schematic diagram illustrating a flow chart of an image processing method performed by the computation circuit in accordance with embodiments of the present invention.

Referring to FIG. 5, FIG. 5 is a schematic diagram illustrating a flow chart of an image processing method 500 performed by the computation circuit 110 in accordance with embodiments of the present invention. The image processing method 500 is performed to reduce the color bleeding.

In the image processing method 500, at first, step 510 is performed to provide the input image 300. Then, step 520 is performed to convert the input image 300 to the original image 300B. In some embodiments, step 520 includes gamma operations to obtain each of pixel luminances of all the pixels of the original image 300B. For example, each of grey levels of the pixels 311*g* is transformed to obtain pixel luminances of the pixels 311*g*. Each of grey levels of the pixels 312*r* is transformed to obtain pixel luminances of the pixels 312*r*. Each of grey levels of the pixels 313*b* is transformed to obtain pixel luminances of the pixels 313*b*. Each of grey levels of the black pixels BK is transformed to obtain pixel luminances of the black pixels BK. Hereinafter, the pixels 311*g* at the bottom side of the straight line pattern 300L are referred to as "(first) lower pixels", the black pixels 314*k* located on the straight line pattern 300L are referred to as "(first) upper pixels", the sub-pixel structures 411*g* corresponding to the pixels 311*g* are referred to as "lower sub-pixel structures", and the sub-pixel structures 414*g* corresponding to the black pixels 314*k* are referred to as "upper sub-pixel structures".

Thereafter, step 530 for vertical sub-pixel rendering is performed to obtain a sub-pixel rendering image according to the original image 300B. In step 530, at first, step 532 is performed to perform a first vertical sub-pixel rendering method on the pixel luminances of the lower pixels 311*g* according to a first color ratio to obtain first rendering sub-pixel luminances. In some embodiments, the first vertical sub-pixel rendering method is performed in accordance with the luminances of two adjacent sub-pixel structures having the same color. For example, the first vertical sub-pixel rendering method is performed according to a following equation (1):

$$fL_{fp}'=f\beta\times fL_{fp}+(1-f\beta)\times fL_{l(fp)} \quad (1)$$

In the equation (1), fp is a position of the lower sub-pixel structure 411*g*, l(fp) is a position of a green sub-pixel structure which is closest to and under the lower sub-pixel structure 411*g* at the position fp, $fL_{fp}'$ is the first rendering sub-pixel luminance corresponding to the position fp, $fL_{fp}$ is the pixel luminance of the lower pixel 311*g* corresponding to the position fp, $fL_{l(fp)}$ is the pixel luminance of the green pixel corresponding to the position l(fp), and fβ is the first color ratio.

Since the green sub-pixel structures under the lower sub-pixel structures 411*g* correspond to the black pixels BK, $fL_{l(fp)}$ in this embodiment is zero, and the equation (1) can be modified as follow:

$$fL_{fp}'=f\beta\times fL_{fp} \quad (2)$$

In some embodiments, the first color ratio fβ is bigger than 0 and smaller than 0.5. In this embodiment, the first color ratio fβ is 0.25, but embodiments of this invention are not limited thereto.

Thereafter, step 534 is performed to perform a second vertical sub-pixel rendering method on the pixel luminances of the upper pixels 314*k* according to a second color ratio to obtain second rendering sub-pixel luminances. In some embodiments, the second vertical sub-pixel rendering method is performed in accordance with the luminances of two adjacent sub-pixel structures having the same color. For example, the second vertical sub-pixel rendering method is performed according to a following equation (3):

$$sL_{sp}'=s\beta\times sL_{sp}+(1-s\beta)\times sL_{l(sp)} \quad (3)$$

In the equation (3), sp is a position of the upper sub-pixel structure 414*g* (green sub-pixel structure), l(sp) is a position of a green sub-pixel structure which is closest to and under the upper sub-pixel structure 414*g* at the position sp, $sL_{sp}'$ is the second rendering sub-pixel luminance corresponding to the position sp, $sL_{sp}$ is the pixel luminance of the upper pixel 314*k* corresponding to the position sp, $sL_{l(sp)}$ is the pixel luminance of the green pixel corresponding to the position l(sp), and sβ is the second color ratio.

Since the upper sub-pixel structures 414*g* correspond to the black upper pixels 314*k*, $sL_{sp}$ in this embodiment is zero, and the equation (3) can be modified as follow:

$$sL_{sp}'=(1-s\beta)\times sL_{l(sp)} \quad (4)$$

Further, as shown in FIG. 4, for each of the upper sub-pixel structures 414*g*, the sub-pixel structure closest to and under the upper sub-pixel structure 414*g* is the lower sub-pixel structure 411*g*, thus $sL_{l(sp)}$ is the luminance of corresponding lower pixel 311*g*. The second color ratio sβ may be the same as or different from the first color ratio fβ. In some embodiments, the second color ratio sβ is bigger than 0 and smaller than 0.5. In this embodiment, the second color ratio sβ is 0.25.

Figure 6:
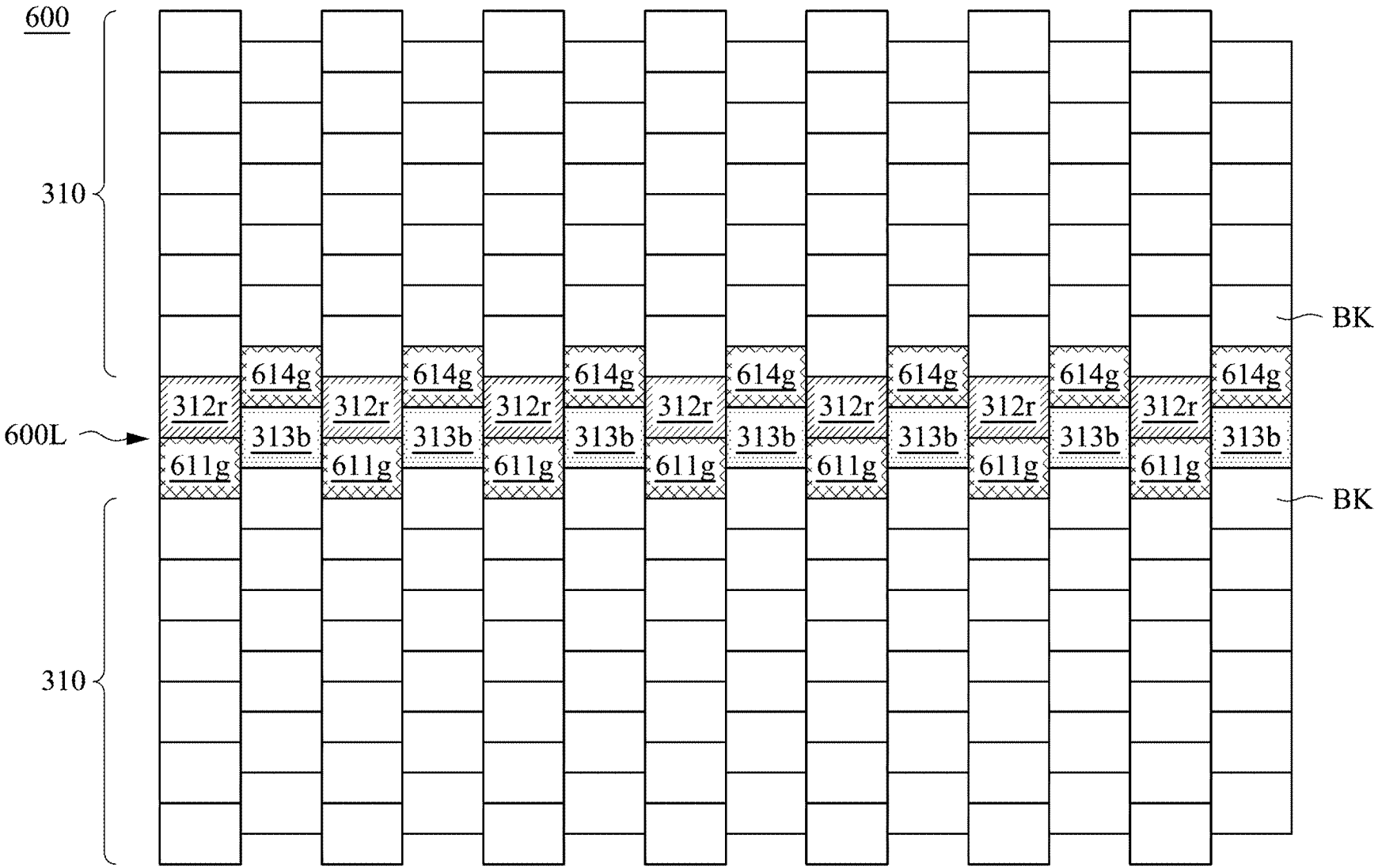
FIG. 6 is a schematic diagram illustrating pixels of a sub-pixel rendering image in accordance with embodiments of the present invention.

After step 530, the sub-pixel rendering image is obtained as shown in FIG. 6. The sub-pixel rendering image 600 includes the black pixels BK and the pixels 312*r*, the pixels 313*b*, rendering pixels 611*g* and 614*g* showing a straight line pattern 600L. In this embodiment, the rendering pixels 611*g* and 614*g* are green.

Comparing with the straight line pattern 300L in the original image 300B in FIG. 3B, the lower pixels 311*g* are replaced by the rendering pixels 611*g*, and the upper pixels 314*k* are replaced by the rendering pixels 614*g*. In this embodiment, each of the rendering pixels 611*g* has the first rendering sub-pixel luminance equal to a quarter of the luminance of the lower pixel 311*g*, and each of the rendering pixels 614*g* has the second rendering sub-pixel luminance equal to three quarters of the luminance of the lower pixel 311*g*.

Figure 7:
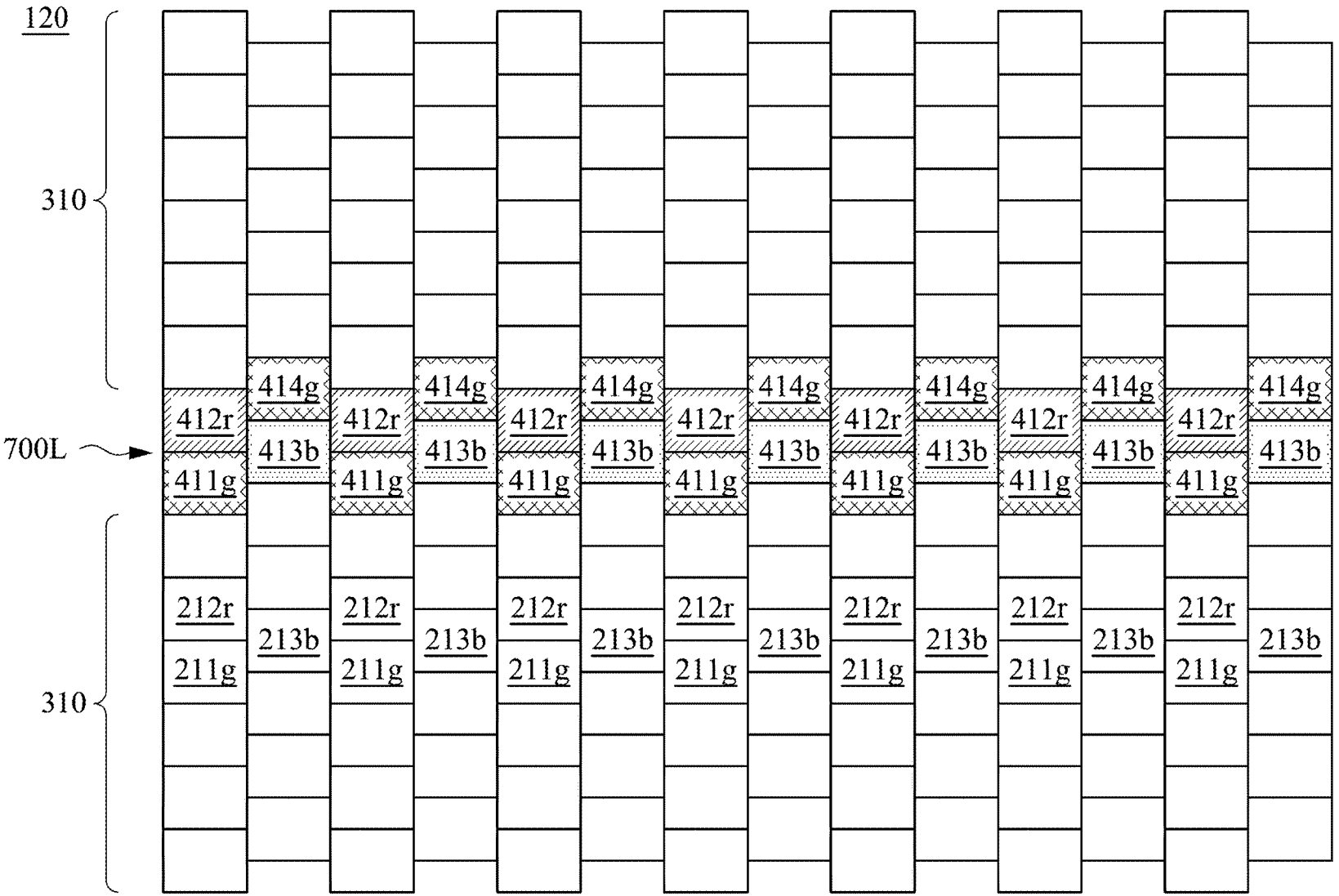
FIG. 7 is a schematic diagram illustrating pixel structures of the display panel showing the sub-pixel rendering image.

Then, step 540 is performed to transform the luminances of all the pixels of the sub-pixel rendering image 600 into plural grey levels. For example, the first rendering sub-pixel luminances of the rendering pixels 611*g* are transformed into plural first rendering grey levels, and the second rendering sub-pixel luminances of the rendering pixels 614*g* are transformed into second rendering grey levels. Thereafter, step 550 is performed to drive the sub-pixel structures of the display panel 120 according to the grey levels of step 540, as shown in FIG. 7. For example, as shown in FIG. 7, a sub-pixel structure line 700L including the upper sub-pixel structures 414*g*, the lower sub-pixel structures 411*g*, the sub-pixel structures 412*r* and the sub-pixel structures 412*b* is driven to show the straight line pattern 300L. The lower sub-pixel structures 411*g* at the bottom side of the sub-pixel structure line 700L are driven according to the first rendering grey levels, and the upper sub-pixel structures 414*g* at the top side of the sub-pixel structure line 700L are driven according to the second rendering grey levels. Comparing with the display panel 120 in FIG. 4, the lower sub-pixel structures 411*g* are driven with a lower gray level, and the upper sub-pixel structures 414*g* are driven with a higher gray level. Therefore, the situation of color bleeding of the display panel 120 is reduced.

Figure 8A:
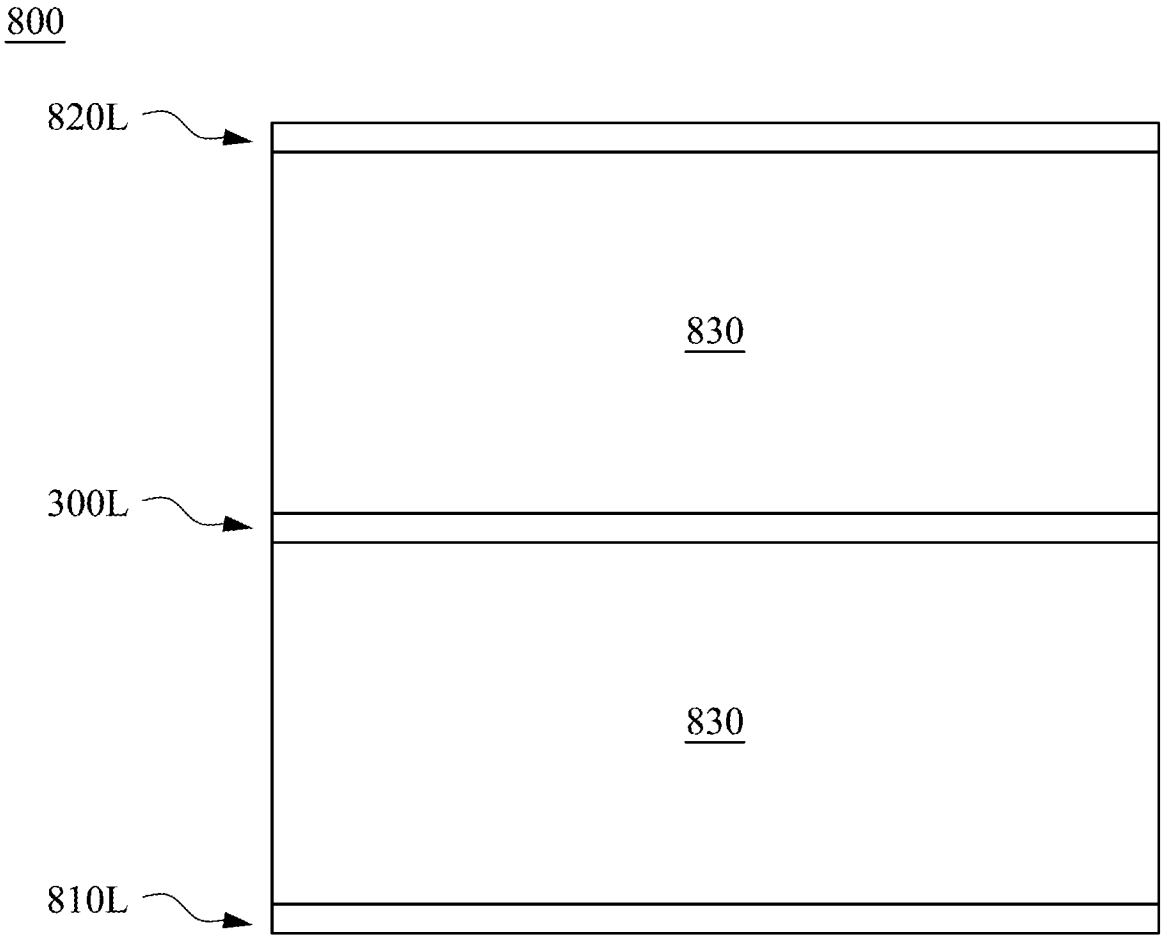
FIG. 8A is a schematic diagram illustrating an input image according to embodiments of the present invention.
Figure 8B:
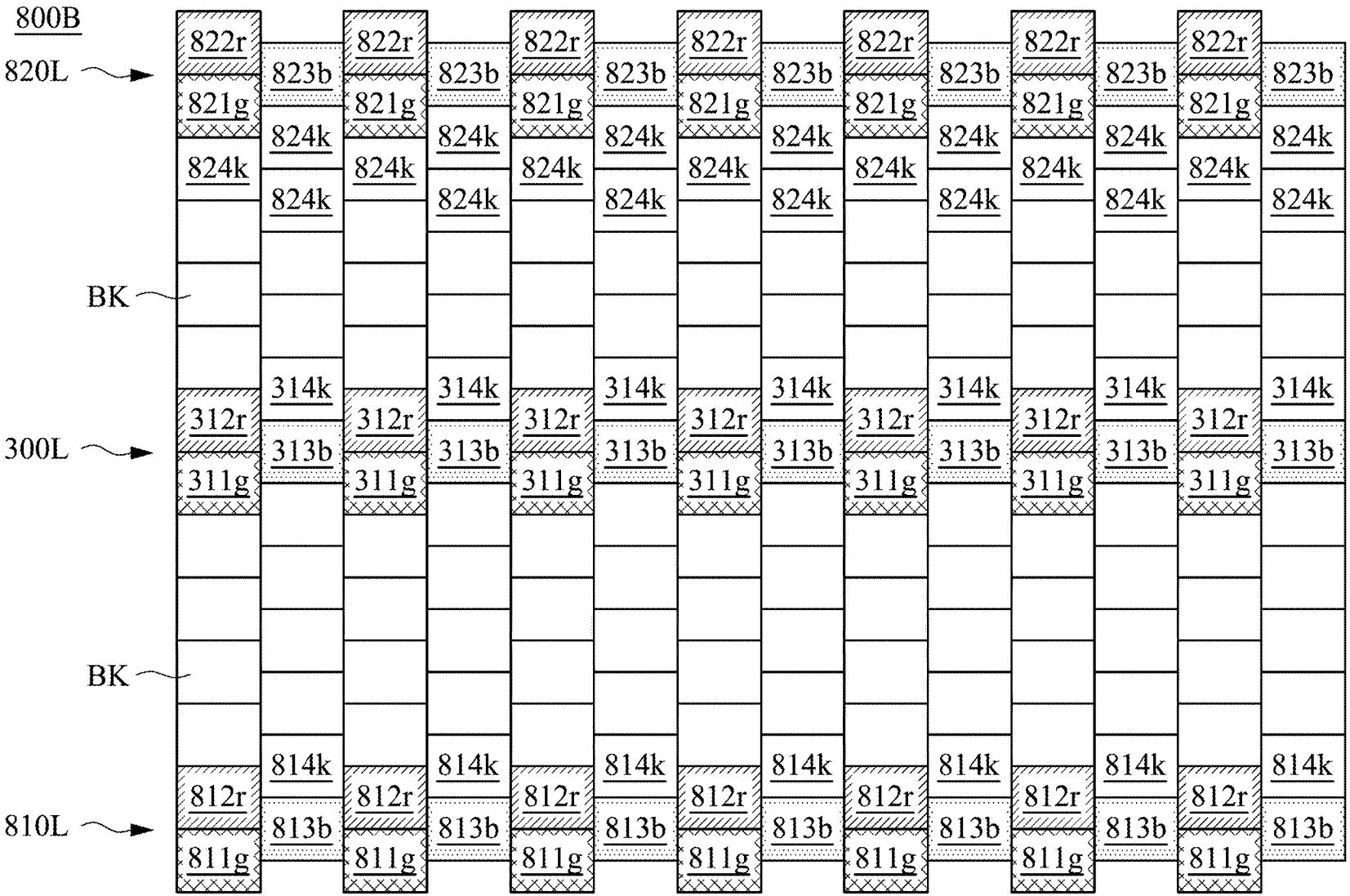
FIG. 8B is a schematic diagram illustrating pixels of an original image corresponding to the sub-pixel structures of the display panel.

Referring to FIG. 8A and FIG. 8B, FIG. 8A is a schematic diagram illustrating an input image 800 according to embodiments of the present invention, and FIG. 8B is a schematic diagram illustrating pixels of an original image 800B corresponding to the sub-pixel structures of the display panel 120. As shown in FIG. 8A, the input image 800 being displayed by the display panel 120 includes the straight line pattern 300L, a lower boundary line pattern 810L an upper boundary line pattern 820L, and dark regions 830. The dark regions 830 are located between the straight line pattern 300L and the lower boundary line pattern 810L, and between the straight line pattern 300L and the upper boundary line pattern 820L. In some embodiments, the lower boundary line pattern 810L and the upper boundary line pattern 820L are white lines. To display the input image 800 through the display panel 120, the computation circuit 110 coverts the input image 800 into an original image 800B as shown in FIG. 8B, in which the original image 800B includes pixels corresponding to the sub-pixel structures of the display panel 120 in a one-to-one manner.

As shown in FIG. 8B, the original image 800 includes the pixels 311*g*, the pixels 312*r* and the pixels 313*b* forming the straight line pattern 300L, pixels 811*g*, pixels 812*r* and pixels 813*b* forming the lower boundary line pattern 810L, pixels 821*g*, pixels 822*r* and pixels 823*b* forming the upper boundary line pattern 820L and the black pixels BK forming the dark regions 830. The black pixels BK include the black pixels 314*k*, black pixels 814*k* and 824*k*. The black pixels 814*k* are located on the lower boundary line pattern 810L and located between the pixels 812*r* and the pixels 813*b*. The black pixels 824*k* are located under the upper boundary line pattern 820L. In some embodiments, the pixels 811*g* and 821*g* are green, the pixels 812*r* and 822*r* are red, and the pixels 813*b* and 823*b* are blue.

Figure 9:
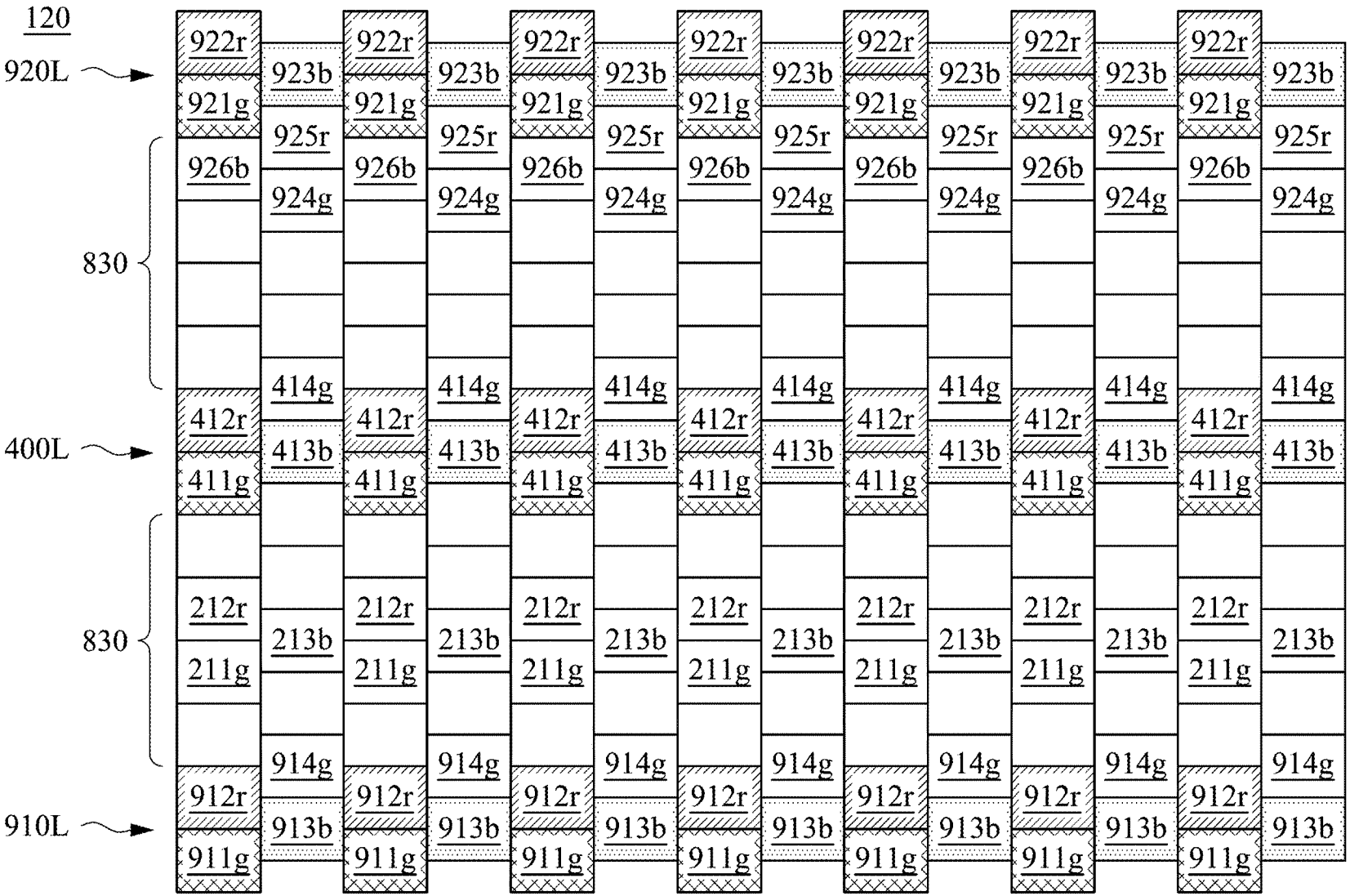
FIG. 9 is a schematic diagram illustrating pixel structures of the display panel showing the original image.

Referring to FIG. 9, when the original image 800 is displayed on the display panel 120, the sub-pixel structure line 400L is driven to show the straight line pattern 300L; a sub-pixel structure line 910L including sub-pixel structures 911*g*, sub-pixel structures 912*r* and sub-pixel structures 912*b* is driven to show the lower boundary line pattern 810L; and a sub-pixel structure line 920L including sub-pixel structures 921*g*, sub-pixel structures 922*r* and sub-pixel structures 922*b* is driven to show the upper boundary line pattern 820L. In some embodiments, the sub-pixel structures 911*g* and 921*g* are driven to show green color (for example the pixels 811*g* and 821*g*), the sub-pixel structures 912*r* and 922*r* are driven to show red color (for example the pixels 812*r* and 822*r*) and the sub-pixel structures 913*b* and 923*b* are driven to show blue color (for example the pixels 813*b*), thereby enabling the display panel 120 to show the lower boundary line pattern 810L and the upper boundary line pattern 820L. Further, other sub-pixel structures, for example the green sub-pixel structures 211*g*, the red sub-pixel structures 212*r*, the blue sub-pixel structures 213*b*, the green sub-pixel structures 414*g*, green sub-pixel structures 914*g* and 924*g*, red sub-pixel structures 925*r* and blue sub-pixel structures 926*b* show black color, thereby enabling the display panel 120 to show the dark regions 830. It is noted that the green sub-pixel structures 914*g* show the black pixels 814*k*, and the green sub-pixel structures 924*g*, the red sub-pixel structures 925*r* and the blue sub-pixel structures 926*b* show the black pixels 824*k*.

Similarly, a situation of color bleeding may occur on the top side of the sub-pixel structure line 910L and occur under the bottom side of the sub-pixel structure line 920L. To reduce the color bleeding, the computation circuit 110 further performs vertical sub-pixel rendering for the sub-pixel structure line 910L and the sub-pixel structure line 920L to obtain corresponding rendering sub-pixel luminances, and drive the display panel 120 by using the corresponding rendering sub-pixel luminances.

Figure 10A:
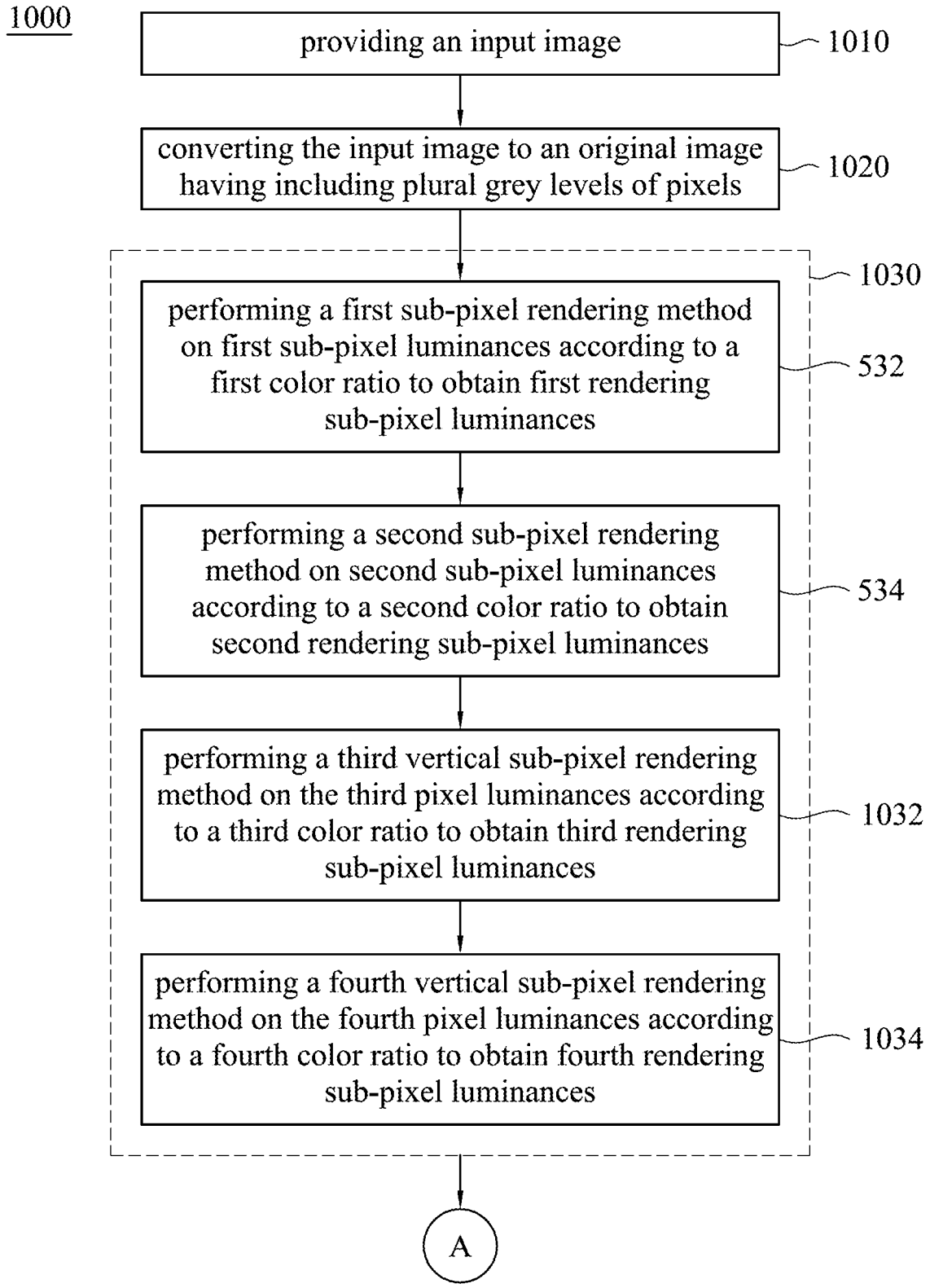
FIG. 10A to FIG. 10B are schematic diagrams illustrating a flow chart of an image processing method performed by the computation circuit in accordance with embodiments of the present invention.
Figure 10B:
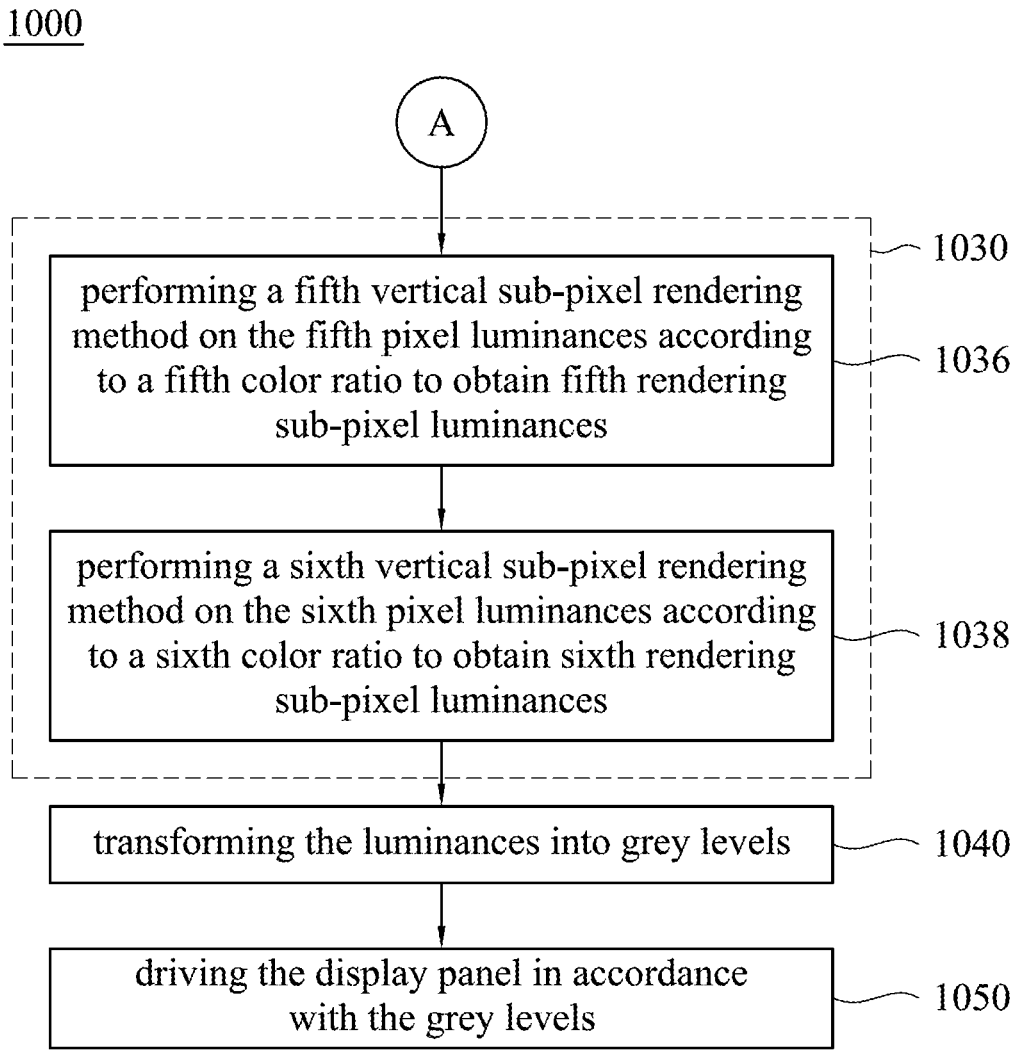

Referring to FIG. 10A to FIG. 10B, FIG. 10A to FIG. 10B are schematic diagrams illustrating a flow chart of an image processing method 1000 performed by the computation circuit 110 in accordance with embodiments of the present invention. The image processing method 1000 is performed to reduce the color bleeding.

In the image processing method 1000, at first, step 1010 is performed to provide the input image 800. Then, step 1020 is performed to convert the input image 800 to the original image 800B. In some embodiments, step 1020 includes gamma operations to obtain each of grey levels of all the pixels of the original image 800B. For example, each of grey levels of the pixels 811*g* and 821*g* is transformed to obtain pixel luminances of the pixels 811*g* and 821*g*. Each of grey levels of the pixels 812*r* and 822*r* is transformed to obtain pixel luminances of the pixels 812*r* and 822*r*. Each of grey levels of the pixels 813*b* and 823*b* is transformed to obtain pixel luminances of the pixels 813*b* and 823*b*. Each of grey levels of the black pixels BK is transformed to obtain pixel luminances of the black pixels BK. Hereinafter, the pixels 811*g* at the bottom side of the lower boundary line pattern 810L are referred to as "(second) lower pixels", the black pixels 814*k* located on the upper boundary line pattern 820L are referred to as "(second) upper pixels", the sub-pixel structures 911*g* corresponding to the pixels 811*g* are referred to as "lower sub-pixel structures", the sub-pixel structures 914*g* corresponding to the black pixels 814*k* are referred to as "upper sub-pixel structures", the pixels 821*g* at the bottom side of the upper boundary line pattern 820L are referred to as "lower pixels", and the sub-pixel structures 921*g* corresponding to the pixels 821*g* are referred to as "lower sub-pixel structures".

Thereafter, step 1030 for vertical sub-pixel rendering is performed to obtain a sub-pixel rendering image according to the original image 800B. In some embodiments, step 1030 includes steps 532-534, thereby obtaining the first rendering sub-pixel luminances and the second rendering sub-pixel luminances corresponding to the sub-pixel structures 411*g*, 412*r*, 413*b* and 414*g* of the sub-pixel structure line 400L.

Then, step 1032 is performed to perform a third vertical sub-pixel rendering method on the pixel luminances of the lower pixels 811*g* according to a third color ratio to obtain third rendering sub-pixel luminances. In some embodiments, the third vertical sub-pixel rendering method is performed in accordance with a following equation (5):

$$tL_{tp}' = t\beta \times tL_{tp} \tag{5}$$

In the equation (5), tp is a position of the lower sub-pixel structure 911*g*, $tL_{tp}'$ is the third rendering sub-pixel luminance corresponding to the position tp, $tL_{tp}$ is the pixel luminance of the lower pixel 811*g* corresponding to the position tp, and tβ is the third color ratio. In some embodiments, the third color ratio tβ is bigger than 0 and smaller than 0.5. In this embodiment, the third color ratio tβ is 0.25, but embodiments of this invention are not limited thereto.

Thereafter, step 1034 is performed to perform a fourth vertical sub-pixel rendering method on the pixel luminances of the upper pixels 814*k* according to a fourth color ratio to obtain fourth rendering sub-pixel luminances. In some embodiments, the fourth vertical sub-pixel rendering method is performed in accordance with the luminances of two adjacent sub-pixel structures having the same color. For example, the fourth vertical sub-pixel rendering method is performed according to a following equation (6):

$$oL_{op}'=o\beta\times oL_{op}+(1-o\beta)\times oL_{l(op)} \quad (6)$$

In the equation (6), op is a position of the upper sub-pixel structure 914g (green sub-pixel structure), l(op) is a position of a green sub-pixel structure which is closest to and under the upper sub-pixel structure 914g at the position op, $oL_{op}'$ is the fourth rendering sub-pixel luminance corresponding to the position op, $oL_{op}$ is the pixel luminance of the upper pixel 814k corresponding to the position op, $oL_{l(op)}$ is the pixel luminance of the green pixel corresponding to the position l(op), and oβ is the fourth color ratio.

Since the upper sub-pixel structures 914g correspond to the black upper pixels 814k, $oL_{op}$ in this embodiment is zero, and the equation (6) can be modified as follow:

$$oL_{op}'=(1-o\beta)\times oL_{l(sp)} \quad (7)$$

Further, as shown in FIG. 9, for each of the upper sub-pixel structures 914g, the sub-pixel structure closest to and under the upper sub-pixel structure 914g is the lower sub-pixel structure 911g, thus $oL_{l(op)}$ is the luminance of corresponding lower pixel 811g. The fourth color ratio oβ may be the same as or different from the third color ratio tβ. In some embodiments, the fourth color ratio oβ is bigger than 0 and smaller than 0.5. In this embodiment, the fourth color ratio oβ is 0.25.

Then, step 1036 is performed to perform a fifth vertical sub-pixel rendering method on the pixel luminances of the lower pixels 821g according to a fifth color ratio to obtain fifth rendering sub-pixel luminances. In some embodiments, the fifth vertical sub-pixel rendering method is performed in accordance with a following equation (8):

$$vL_{vp}'=v\beta\times vL_{vp}+(1-v\beta)\times vL_{l(vp)} \quad (8)$$

In the equation (8), vp is a position of the lower sub-pixel structure 921g, l(vp) is a position of a green sub-pixel structure which is closest to and under the lower sub-pixel structure 921g at the position vp, $vL_{vp}'$ is the fifth rendering sub-pixel luminance corresponding to the position vp, $vL_{vp}$ is the pixel luminance of the lower pixel 821g corresponding to the position vp, $vL_{l(vp)}$ is the pixel luminance of the green pixel corresponding to the position l(vp), and vβ is the first color ratio.

Since the green sub-pixel structures under the lower sub-pixel structures 921g correspond to the black pixels BK, $vL_{l(vp)}$ in this embodiment is zero, and the equation (8) can be modified as follow:

$$vL_{vp}'=v\beta\times vL_{vp} \quad (9)$$

In some embodiments, the fifth color ratio vβ is bigger than 0.5 and smaller than 1. In this embodiment, the fifth color ratio vβ is 0.75, but embodiments of this invention are not limited thereto.

Thereafter, step 1038 is performed to perform a sixth vertical sub-pixel rendering method on the pixel luminances of the pixels 824k corresponding to the sub-pixel structures 924g according to a sixth color ratio to obtain sixth rendering sub-pixel luminances. The sixth rendering sub-pixel luminances calculated by step 1038 correspond to the sub-pixel structures 924g. In some embodiments, the sixth vertical sub-pixel rendering method is performed in accordance with a following equation (10):

$$xL_{xp}'=x\beta\times xL_{xp}+(1-x\beta)\times xL_{u(xp)} \quad (10)$$

In In the equation (10), xp is a position of the sub-pixel structure 924g, u(xp) is a position of a green sub-pixel structure which is closest to and on the lower sub-pixel structure 924g at the position xp, $xL_{xp}'$ is the sixth rendering sub-pixel luminance corresponding to the position xp, $xL_{xp}$ is the pixel luminance of the pixel 824k corresponding to the position xp, $xL_{u(xp)}$ is the pixel luminance of the green pixel corresponding to the position u(xp), and xβ is the sixth color ratio.

Further, as shown in FIG. 9, for each of the sub-pixel structures 924g, the sub-pixel structure closest to and on the sub-pixel structure 924g is the lower sub-pixel structure 921g, thus $xL_{u(xp)}$ is the luminance of corresponding lower pixel 821g. The sixth color ratio xβ may be the same as or different from the fifth color ratio vβ. In some embodiments, the sixth color ratio xβ is bigger than 0.5 and smaller than 1. In this embodiment, the sixth color ratio xβ is 0.75.

Figure 11:
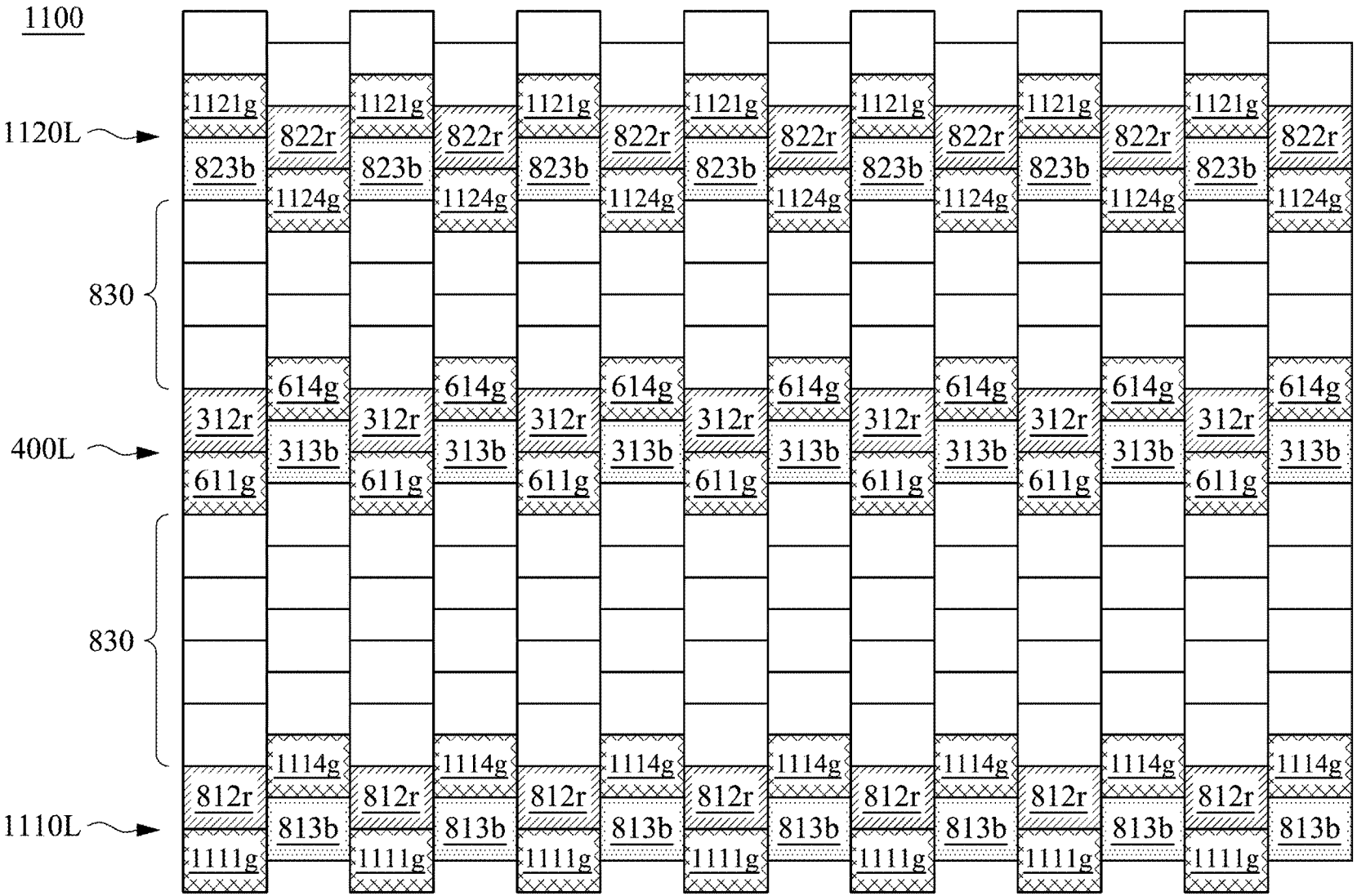
FIG. 11 is a schematic diagram illustrating pixels of a sub-pixel rendering image in accordance with embodiments of the present invention.

After step 1030, the sub-pixel rendering image is obtained as shown in FIG. 11. The sub-pixel rendering image 1100 includes the straight line pattern 600L, a lower boundary line pattern 1110L and an upper boundary line pattern 1120L. The lower boundary line pattern 1110L includes the pixels 812r, the pixels 813b, rendering pixels 1111g and rendering pixels 1114g. The upper boundary line pattern 1120L includes the pixels 822r, the pixels 823b, rendering pixels 1121g and rendering pixels 1124g. In this embodiment, the rendering pixels 1111g, 1114g, 1121g and 1124g are green.

Comparing with the lower boundary line pattern 810L in the original image 800B in FIG. 8B, the lower pixels 811g are replaced by the rendering pixels 1111g, and the upper pixels 814k are replaced by the rendering pixels 1114g. In this embodiment, each of the rendering pixels 1111g has the third rendering sub-pixel luminance equal to a quarter of the luminance of the lower pixel 811g, and each of the rendering pixels 1114g has the second rendering sub-pixel luminance equal to three quarters of the luminance of the lower pixel 811g.

Comparing with the upper boundary line pattern 820L in the original image 800B in FIG. 8B, the upper boundary line pattern 1120L is moved downward by a distance of a pixel. For example, the pixels 824k correspond to the sub-pixel structures 926b are replaced by the pixels 823b; the pixels 824k correspond to the sub-pixel structures 925r are replaced by the pixels 822r; the pixels 821g are replaced by the pixels 1121g; the pixels 824k correspond to the sub-pixel structures 924g are replaced by the pixels 1124g. In this embodiment, each of the rendering pixels 1121g has the fifth rendering sub-pixel luminance equal to three quarters of the luminance of the lower pixel 821g, and each of the rendering pixels 1124g has the sixth rendering sub-pixel luminance equal to a quarter of the luminance of the lower pixel 821g.

Then, step 1040 is performed to transform the luminances of all the pixels of the sub-pixel rendering image 1100 into plural grey levels. For example, the first rendering sub-pixel luminances of the rendering pixels 611g is transformed into plural first rendering grey levels; the second rendering sub-pixel luminances of the rendering pixels 614g are transformed into second rendering grey levels; the third rendering sub-pixel luminances of the rendering pixels 1111g are transformed into plural third rendering grey levels; the fourth rendering sub-pixel luminances of the rendering pixels 1114g are transformed into plural fourth rendering grey levels; the fifth rendering sub-pixel luminances of the rendering pixels 1121g are transformed into plural fifth rendering grey levels; the sixth rendering sub-pixel luminances of the rendering pixels 1124g are transformed into plural sixth rendering grey levels.

Figure 12:
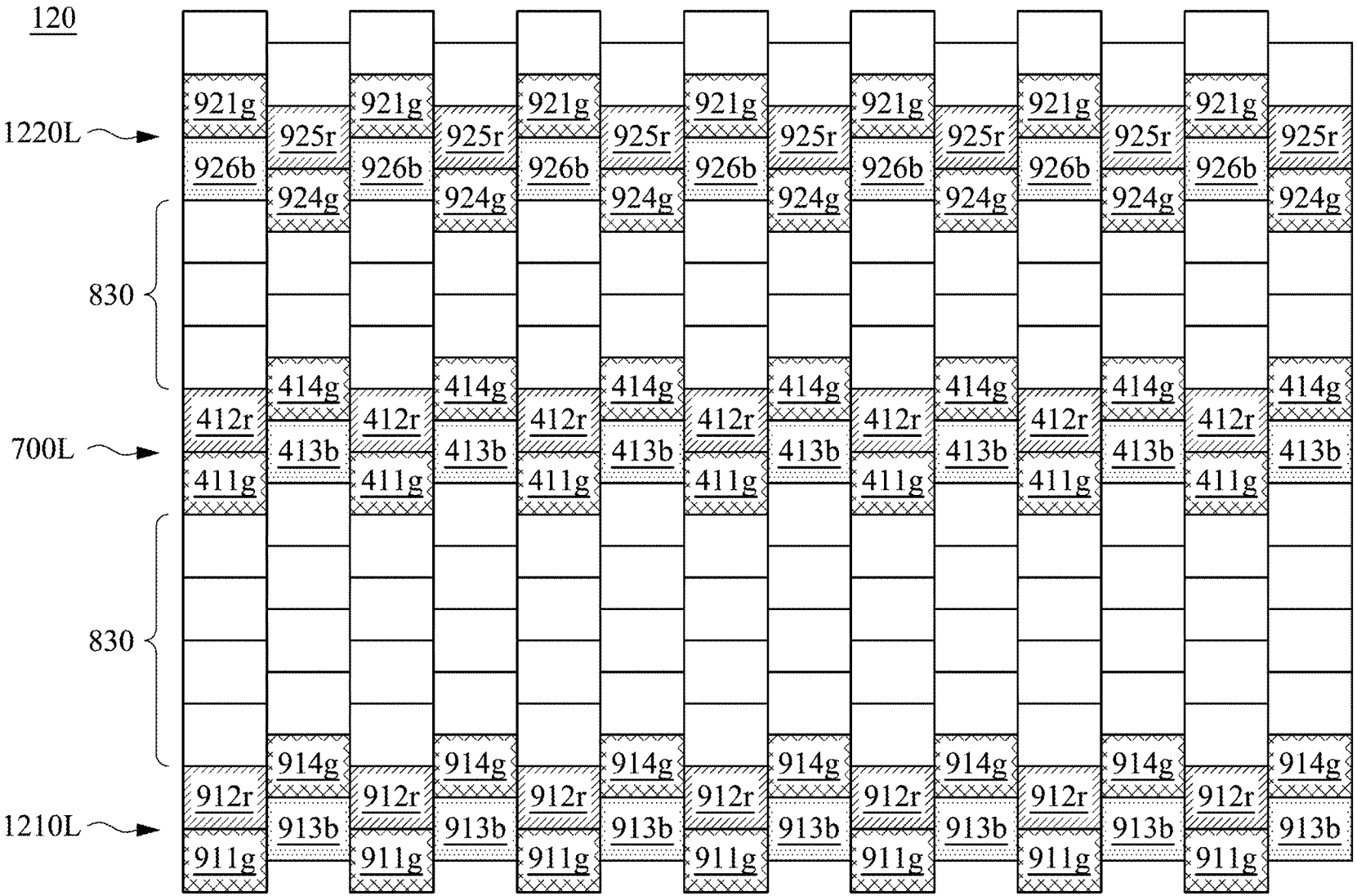
FIG. 12 is a schematic diagram illustrating pixel structures of the display panel showing the sub-pixel rendering image.

Thereafter, step 1050 is performed to drive the sub-pixel structures of the display panel 120 according to the grey levels of step 1040, as shown in FIG. 12. For example, as shown in FIG. 12, a sub-pixel structure line 1210L including the upper sub-pixel structures 914*g*, the lower sub-pixel structures 911*g*, the sub-pixel structures 912*r* and sub-pixel structures 912*b* is driven to show the lower boundary line pattern 810L of FIG. 8A. The lower sub-pixel structures 911*g* at the bottom side of the sub-pixel structure line 1210L are driven according to the third rendering grey levels, and the upper sub-pixel structures 914*g* at the top side of the sub-pixel structure line 1210L are driven according to the fourth rendering grey levels. Comparing with the display panel 120 in FIG. 4, the lower sub-pixel structures 911*g* are driven with a lower gray level, and the upper sub-pixel structures 914*g* are driven with a higher gray level. Therefore, the color bleeding is reduced.

For another example, as shown in FIG. 12, a sub-pixel structure line 1220L including the sub-pixel structures 924*g*, the lower sub-pixel structures 921*g*, the sub-pixel structures 925*r* and the sub-pixel structures 926*b* is driven to show the upper boundary line pattern 820L of FIG. 8A. The sub-pixel structures 1124*g* at the bottom side of the sub-pixel structure line 1220L are driven according to the sixth rendering grey levels, and the sub-pixel structures 921*g* at the top side of the sub-pixel structure line 1220L are driven according to the fifth rendering grey levels. Comparing with the display panel 120 in FIG. 4, the sub-pixel structures 924*g* are driven with a lower gray level, and the sub-pixel structures 921*g* are driven with a higher gray level. Therefore, the color bleeding is reduced.

Figure 13:
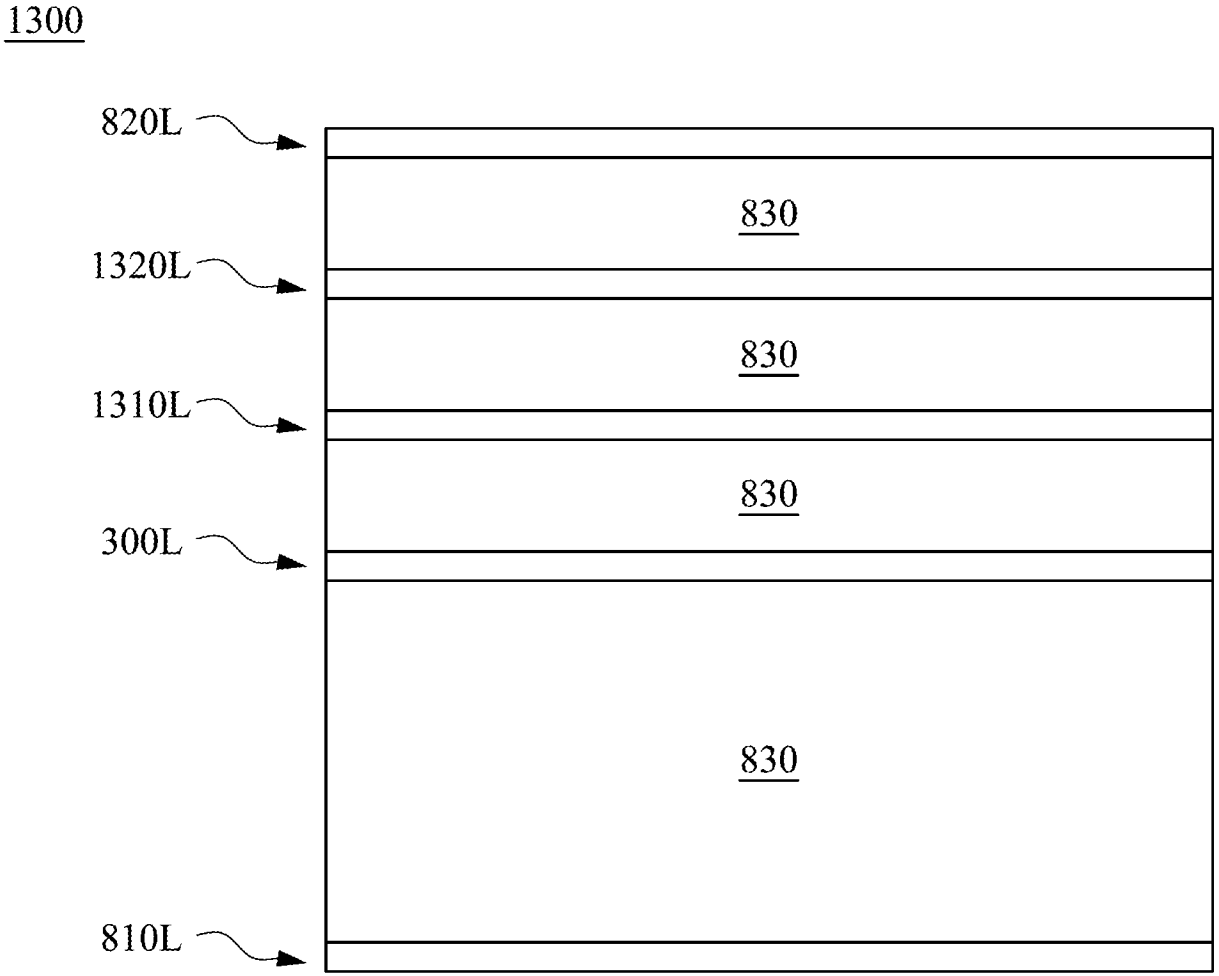
FIG. 13 is a schematic diagram illustrating an input image according to embodiments of the present invention.

Referring to FIG. 13, FIG. 13 is a schematic diagram illustrating an input image 1300 according to embodiments of the present invention. The input image 1300 is similar to the input image 800 of FIG. 8A. The input image 1300 further includes straight line patterns 1310L and 1320L located between the straight line pattern 300L and the upper boundary line pattern 820L. When the straight line patterns 1310L and 1320L are displayed by the display panel 120. The computation circuit 110 performs vertical sub-pixel rendering steps on the pixels of the straight line patterns 1310L and 1320L to reduce the color bleeding. For example, plural sub-pixel rendering methods similar to the above fifth sub-pixel rendering method and sixth sub-pixel rendering method are performed on the pixels of the straight line patterns 1310L and 1320L. In some embodiments, the color ratios of the sub-pixel rendering methods performed on the pixels of the straight line patterns 1310L and 1320L can be gradually varied. In some embodiments, a seventh color ratio nβ is used by the sub-pixel rendering methods performed on the pixels of the straight line patterns 1320L, and a eighth color ratio eβ is used by the sub-pixel rendering methods performed on the pixels of the straight line patterns 1310L, and xβ>nβ>eβ>fβ. In this embodiment, xβ=0.75, nβ=0.6, eβ=0.45, and fβ=0.25.

Although the present invention has been described in considerable detail with reference to certain embodiments thereof, other embodiments are possible. Therefore, the spirit and scope of the appended claims should not be limited to the description of the embodiments contained herein. It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. An image processing method, comprising:

providing an original image, wherein the original image comprises a straight line pattern and a plurality of first upper pixels located adjoining an upper side of the straight line pattern, wherein the straight line pattern comprises a plurality of first pixels, a plurality of second pixels and a plurality of third pixels, and the first pixels are first lower pixels located at a lower side of the straight line pattern;

providing a display panel configured to display the original image, wherein the display panel comprises a plurality of first sub-pixel structures corresponding to the first lower pixels and the first upper pixels, a plurality of second sub-pixel structures corresponding to the second pixels and a plurality of third sub-pixel structures corresponding to the third pixels, and the first sub-pixel structures comprises a plurality of first lower sub-pixel structures corresponding to the first lower pixels and a plurality of first upper sub-pixel structures corresponding to the first upper pixels;

obtaining a plurality of first pixel luminances of the first lower pixels and a plurality of second pixel luminances of the first upper pixels in accordance with the original image, wherein the first lower pixels correspond to a predetermined rendering color;

performing a first vertical sub-pixel rendering operation on the first pixel luminances according to a first color ratio to obtain a plurality of first rendering sub-pixel luminances;

performing a second vertical sub-pixel rendering operation on the second pixel luminances according to a second color ratio to obtain a plurality of second rendering sub-pixel luminances;

transforming the first rendering sub-pixel luminances into a plurality of first rendering grey levels, and transforming the second rendering sub-pixel luminances into a plurality of second rendering grey levels; and driving the first lower sub-pixel structures according to the first rendering grey levels, and driving the first upper sub-pixel structures according to the second rendering grey level;

wherein the first vertical sub-pixel rendering method is performed according to a following equation:

$$fL_{fp}'=f\beta\times fL_{fp}$$

wherein fβ is the first color ratio, fp is a position of the lower sub-pixel structure, $fL_{fp}$ is the pixel luminance of the first lower pixel corresponding to the position fp, and $fL_{fp}'$ is the first rendering sub-pixel luminance;

wherein the second vertical sub-pixel rendering method is performed according to a following equation:

$$sL_{sp}'=(1-s\beta)\times sL_{l(sp)}$$

wherein sβ is the second color ratio, sp is a position of the upper sub-pixel structure, l(sp) is a position of an adjacent sub-pixel structure closest to and under the upper sub-pixel structure at the position sp, $sL_{l(sp)}$ is the pixel luminance of a pixel having a color the same as the color of the first lower pixel and corresponding to the position l(sp), and the adjacent sub-pixel structure has a color the same as the upper sub-pixel structure at the position sp, and $sL_{sp}'$ is the second rendering sub-pixel luminance.

2. The image processing method of claim 1, wherein fβ is 0.25.

3. The image processing method of claim 1, wherein sβ is 0.25.

4. The image processing method of claim 1, wherein the first sub-pixel structures correspond to green, the second sub-pixel structures correspond to red, and the third sub-pixel structures correspond to blue.

5. The image processing method of claim 1, wherein the original image further comprises a lower boundary line pattern and a plurality of second upper pixels located adjoining an upper side of the lower boundary line pattern, the lower boundary line pattern comprises a plurality of fourth pixels, a plurality of fifth pixels and a plurality of sixth pixels, and the fourth pixels are second lower pixels located at a lower side of the lower boundary line pattern;

the display panel further comprises a plurality of fourth sub-pixel structures corresponding to the second lower pixels and the second upper pixels, a plurality of fifth sub-pixel structures corresponding to the fifth pixels and a plurality of sixth sub-pixel structures corresponding to the sixth pixels, and the fourth sub-pixel structures comprises a plurality of second lower sub-pixel structures corresponding to the second lower pixels and a plurality of second upper sub-pixel structures corresponding to the second upper pixels.

6. The image processing method of claim 5, further comprising:

obtaining a plurality of third pixel luminances of the second lower pixels and a plurality of fourth pixel luminances of the second upper pixels in accordance with the original image, wherein the fourth pixels correspond to the predetermined rendering color;

performing a third vertical sub-pixel rendering method on the third pixel luminances according to a third color ratio to obtain a plurality of third rendering sub-pixel luminances;

performing a fourth vertical sub-pixel rendering method on the third pixel luminances according to a fourth ratio to obtain a plurality of fourth rendering sub-pixel luminances;

transforming the third rendering sub-pixel luminances into a plurality of third rendering grey levels, and transforming the fourth rendering sub-pixel luminances into a plurality of fourth rendering grey levels; and driving the second lower sub-pixel structures according to the third rendering grey levels, and driving the second upper sub-pixel structures according to the fourth rendering grey level.

7. The image processing method of claim 6, wherein the third vertical sub-pixel rendering method is performed according to a following equation:

$$tL_{tp}'=t\beta\times tL_{tp}$$

Wherein tβ is the third color ratio, $tL_{tp}$ is the third pixel luminance corresponding to the second lower pixel at the position tp, and $tL_{tp}'$ is the third rendering sub-pixel luminance corresponding to the position tp.

8. The image processing method of claim 7, wherein tβ is 0.25.

9. The image processing method of claim 7, wherein the fourth sub-pixel structures correspond to green, the fifth sub-pixel structures correspond to red, and the sixth sub-pixel structures correspond to blue.

10. The image processing method of claim 1, wherein the original image further comprises an upper boundary line pattern, the upper boundary line pattern comprises a plurality of seventh pixels, a plurality of eighth pixels and a plurality of ninth pixels, and the seventh pixels are located at a lower side of the upper boundary line pattern;

the display panel further comprises a plurality of seventh sub-pixel structures corresponding to the seventh pixels, a plurality of eighth sub-pixel structures corresponding to the eighth pixels, a plurality of ninth sub-pixel structures corresponding to the ninth pixels, a plurality of tenth sub-pixel structures adjacent to the seventh sub-pixel structures, a plurality of eleventh sub-pixel structures adjacent to the eighth sub-pixel structure, a plurality of twelfth sub-pixel structures adjacent to the ninth pixels sub-pixel structure;

wherein the tenth sub-pixel structures and the seventh sub-pixel structures correspond to the same color, the eleventh sub-pixel structures and the eight sub-pixel structures correspond to the same color, and the twelfth sub-pixel structures and the ninth sub-pixel structures correspond to the same color.

11. The image processing method of claim 10, further comprising:

obtaining a plurality of fifth pixel luminances of the seventh pixels in accordance with the original image, wherein the seventh pixels correspond to the predetermined rendering color;

performing a fifth vertical sub-pixel rendering method on the fifth pixel luminances according to a fifth color ratio to obtain a plurality of fifth rendering sub-pixel luminances;

performing a sixth vertical sub-pixel rendering method on a sixth pixel luminance according to a sixth color ratio to obtain a plurality of sixth rendering sub-pixel luminances, wherein the sixth pixel luminances is a predetermined value;

transforming the fifth rendering sub-pixel luminances into a plurality of fifth rendering grey levels, and transforming the sixth rendering sub-pixel luminances into a plurality of sixth rendering grey levels; and driving the seventh sub-pixel structures according to the sixth rendering grey levels, and driving the tenth sub-pixel structures according to the fifth rendering grey levels.

12. The image processing method of claim 11, wherein the seventh sub-pixel structures correspond to green, the eighth sub-pixel structures correspond to red, and the ninth sub-pixel structures correspond to blue.

13. A display device, comprising:

a computation circuit configured to receive an original image, wherein the original image comprises a straight line pattern and a plurality of first upper pixels located adjoining an upper side of the straight line pattern, wherein the straight line pattern comprises a plurality of first pixels, a plurality of second pixels and a plurality of third pixels, and the first pixels are first lower pixels located at a lower side of the straight line pattern, a display panel configured to display the original image, wherein the display panel comprises a plurality of first sub-pixel structures corresponding to the first lower pixels and the first upper pixels, a plurality of second sub-pixel structures corresponding to the second pixels and a plurality of third sub-pixel structures corresponding to the third pixels, and the first sub-pixel structures comprises a plurality of first lower sub-pixel structures corresponding to the first lower pixels and a plurality of first upper sub-pixel structures corresponding to the first upper pixels;

wherein the computation circuit is further configured to:

obtain each of grey levels of the first lower pixels and the first upper pixels to obtain a plurality of first pixel luminances of the first lower pixels and a plurality of second pixel luminances of the first upper pixels, wherein the first pixels correspond to a predetermined rendering color;

perform a first vertical sub-pixel rendering method on the first pixel luminances according to a first color ratio to obtain a plurality of first rendering sub-pixel luminances;

perform a second vertical sub-pixel rendering method on the second pixel luminances according to a second color ratio to obtain a plurality of second rendering sub-pixel luminances;

transform the first rendering sub-pixel luminances into a plurality of first rendering grey levels, and transforming the second rendering sub-pixel luminances into a plurality of second rendering grey levels; and drive the first lower sub-pixel structures according to the first rendering grey levels, and drive the first upper sub-pixel structures according to the second rendering grey level;

wherein the first vertical sub-pixel rendering method is performed according to a following equation:

$$fL_{fp}'=f\beta\times fL_{fp}$$

wherein fβ is the first color ratio, fp is a position of the lower sub-pixel structure, $fL_{fp}$ is the pixel luminance of the first lower pixel corresponding to the position fp, and $fL_{fp}'$ is the first rendering sub-pixel luminance;

wherein the second vertical sub-pixel rendering method is performed according to a following equation:

$$sL_{sp}'=(1-s\beta)\times sL_{l(sp)}$$

wherein sβ is the second color ratio, sp is a position of the upper sub-pixel structure, l(sp) is a position of an adjacent sub-pixel structure closest to and under the upper sub-pixel structure at the position sp, $sL_{l(sp)}$ is the pixel luminance of a pixel having a color the same as the color of the first lower pixel and corresponding to the position l(sp), and the adjacent sub-pixel structure has a color the same as the upper sub-pixel structure at the position sp, and $sL_{sp}'$ is the second rendering sub-pixel luminance.

14. The display device of claim 13, wherein fβ is 0.25.

15. The display device of claim 13, wherein sβ is 0.25.

16. The display device of claim 13, wherein the first sub-pixel structures correspond to green, the second sub-pixel structures correspond to red, and the third sub-pixel structures correspond to blue.

* * * * *